US006622953B2

(12) United States Patent
Inana et al.

(10) Patent No.: US 6,622,953 B2
(45) Date of Patent: Sep. 23, 2003

(54) ROLL HOLDER DEVICE FOR SUPPORTING RECORDING MATERIAL ROLL AND SUPPLY MAGAZINE WITH THE SAME

(75) Inventors: Katsuya Inana, Saitama (JP); Tomohiko Kono, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 3 days.

(21) Appl. No.: 09/742,364

(22) Filed: Dec. 22, 2000

(65) Prior Publication Data

US 2001/0006202 A1 Jul. 5, 2001

(30) Foreign Application Priority Data

| | | |
|---|---|---|
| Dec. 22, 1999 | (JP) | 11-364298 |
| Dec. 24, 1999 | (JP) | 11-367605 |
| Jan. 11, 2000 | (JP) | 2000-002200 |
| Jan. 11, 2000 | (JP) | 2000-002201 |

(51) Int. Cl.[7] ..... G03B 23/02

(52) U.S. Cl. ..... 242/348; 242/423.2; 242/599.1; 242/599.3; 242/599.4; 347/214

(58) Field of Search ..... 242/348, 598.3, 242/598.4, 599.3, 599.4, 599.1, 422.4, 423.1, 423.2, 348.4; 347/214, 154

(56) References Cited

U.S. PATENT DOCUMENTS

| | | | | |
|---|---|---|---|---|
| 3,329,367 A | * | 7/1967 | Paradiso | 242/599.3 |
| 4,671,466 A | * | 6/1987 | Jespersen et al. | 242/599.4 |
| 6,315,235 B1 | * | 11/2001 | Breyer et al. | 242/422.4 |

* cited by examiner

*Primary Examiner*—John Q. Nguyen
(74) *Attorney, Agent, or Firm*—Sughrue Mion, PLLC

(57) ABSTRACT

A roll holder device is for use with a recording paper roll including a tubular spool shaft and continuous recording paper wound about the tubular spool shaft in a roll form. In the roll holder device, first and second holder cores are inserted in respectively first and second ends of the tubular spool shaft. A holder frame supports the first and second holder cores in a rotatable manner. Anti-dropping levers prevent the tubular spool shaft from dropping from the first and second holder cores by pushing a shaft inner surface of the tubular spool shaft.

21 Claims, 20 Drawing Sheets

ROLL HOLDER DEVICE FOR SUPPORTING RECORDING MATERIAL ROLL AND SUPPLY MAGAZINE WITH THE SAME

BACKGROUND OF THE INVENTION

1. Field of the Invention

The present invention relates to a roll holder device for supporting a recording material roll and a supply magazine with the same. More particularly, the present invention relates to a roll holder device and supply magazine in which recording material to be supplied can be appropriately positioned with ease.

2. Description Related to the Prior Art

A printer is used with recording material. For example, a color thermal printer is used with thermosensitive recording paper. The recording material has a form of a recording material roll, which includes a tubular spool shaft and the recording material wound about the tubular spool shaft in a roll form. A roll holder device is used to hold the recording material roll. The combination of the recording material roll and the roll holder device is set in a supply magazine, or directly in a supply chamber of the printer.

The roll holder device includes a pair of paper holder components, each of which is constituted of a holder core and a bearing member. The holder core is inserted in, and fitted inside, an axial end of the tubular spool shaft of the recording material roll. The bearing member supports the holder core in a rotatable manner. The bearing member is fitted in, and secured to, a cutout formed in a holder frame, which is an element included in the supply magazine or the supply chamber of the printer.

To supply the recording material with high precision, it is necessary that the holder core of the paper holder components should be firmly fitted in the tubular spool shaft, and a relative position of the recording material roll relative to the bearing member should be constant as predetermined. If fitting of the holder core on the tubular spool shaft is insufficiently firm, the roll holder device is likely to drop from the tubular spool shaft in setting the recording material roll into the supply magazine or the like. In contrast, if fitting of the holder core on the tubular spool shaft is excessively firm, the roll holder device is highly difficult to unload from the recording material roll.

In setting the recording material roll into the supply magazine, it is likely that turns of the recording material become loose, or the turns at an end face of the recording material roll become shaped conically without a neatly flat shape. To prevent such problems, an adhesive tape is used to secure a front edge of the recording material to the outside of the recording material roll. It is necessary to remove the adhesive tape after the recording material roll is set into the supply magazine. However, an inadvertent user is likely to forget the removal upon setting the recording material roll. If the printer is operated for supply of the recording material with the adhesive tape kept attached, no recording material is supplied. Furthermore, a mechanism for paper supply is likely to be broken in the printer or the supply magazine.

The roll holder device according to the prior art includes the paper holder components having an equal size. If the paper holder components are set on the end faces of the recording material roll in either orientation, the roll holder device can be set in the supply chamber or the supply magazine. A problem arises in failure in supply of the recording material because of a situation where the recording material roll is set in the supply magazine in a direction opposite to a proper direction.

Another problems lies in that propriety in a fitted state of the paper holder components into the tubular spool shaft cannot be checked readily. The paper holder components are likely to be set in a halfway inserted state at the supply magazine or the printer. It is conceivable that a plate spring is used in the supply magazine or the supply chamber of the printer for pressing an end face of the paper holder components to position the same in the axial direction. If the recording material roll is set with the paper holder components oriented improperly, the plate spring is deformed. There occurs an offset state of the recording material roll in the width direction.

Furthermore, a pad with a felt member is provided in the roll holder device, and pressed against the holder core for application of rotational load. This is for the purpose of applying back tension to the recording material, and preventing oblique movement or jamming of the recording material by increasing reliability in the feeding. However, the pad causes application of rotational load also in the course of winding the recording material back to the recording material roll. In the course or rewinding, there occurs a problem of looseness between turns of the recording material in the recording material roll because a considerable difference occurs in an angular speed between the inner turns and the outermost turn.

SUMMARY OF THE INVENTION

In view of the foregoing problems, an object of the present invention is to provide a roll holder device and a supply magazine in which precision in supply of recording material can be high by firmly keeping paper holder components positioned on a tubular spool shaft of a recording material roll.

Another object of the present invention is to provide a roll holder device and a supply magazine in which end faces of a recording material roll can be neatened to prevent loosening of the recording material roll to be set into a supply chamber.

Still another object of the present invention is to provide a roll holder device and a supply magazine in which setting of a recording material roll is allowed only which the recording material roll is oriented in an appropriate direction.

Another object of the present invention is to provide a roll holder device and a supply magazine in which oblique movement or jamming of recording material can be prevented by lowering rotational load applied to a holder core while the recording material is wound back.

In order to achieve the above and other objects and advantages of this invention, a roll holder device is for use with a recording material roll including a tubular spool shaft and continuous recording material wound about the tubular spool shaft in a roll form. In the roll holder device, first and second holder cores are inserted in respectively first and second ends of the tubular spool shaft. In a supply magazine, there is a holder frame member which supports the first and second holder cores in a rotatable manner. In the roll holder device, an anti-dropping mechanism prevents the tubular spool shaft from dropping from the first and second holder cores by pushing a shaft inner surface of the tubular spool shaft.

Furthermore, a bias mechanism biases and presses the anti-dropping mechanism against the shaft inner surface.

The anti-dropping mechanism includes a push surface for contacting the shaft inner surface. Plural claws are formed to project from the push surface, for being thrust into the shaft inner surface.

The first holder core has a greater size in an axial direction than the second holder core.

Ends of the first and second holder cores are engaged with each other.

Furthermore, a core sleeve is formed with the first holder core. An access opening is formed through the core sleeve. The anti-dropping mechanism includes an anti-dropping lever, shiftable between first and second positions, contained in the core sleeve when in the first position, and protruded toward an outside of the core sleeve through the access opening when in the second position, for pressing the push surface against the shaft inner surface.

The anti-dropping lever has a driven end portion disposed in the core sleeve. Furthermore, a connection shaft is formed with the second holder core, inserted in the core sleeve, for shifting the anti-dropping lever from the first position to the second position by pushing the driven end portion.

The first and second holder cores are rotatable in unwinding and winding directions. Furthermore, a load changer mechanism applies higher rotational load to the first and second holder cores during rotation in the unwinding direction than during rotation in the winding direction.

According to one aspect of the invention, the load changer mechanism includes a friction pad member for effecting braking operation to each of the first and second holder cores. A one-way clutch connects each holder core to the friction pad member during rotation in the unwinding direction, and disconnects each holder core from the friction pad member during rotation in the winding direction.

The one-way clutch includes a ratchet wheel, secured to each holder core, and having at least one ratchet claw. A tube member is engaged with the friction pad member, for containing the ratchet wheel, wherein the tube member has at least one tooth disposed inside, and when each holder core rotates in the unwinding direction, rotates in the unwinding direction by mesh of the tooth with the ratchet claw, and when each holder core rotates in the winding direction, disengages the tooth from the ratchet claw.

Furthermore, first and second cutouts are formed in the holder frame member, for supporting respectively the first and second holder cores in a rotatable manner. At least one orientation regulator mechanism prevents the first holder core from being set in the second cutout or the second holder core from being set in the first cutout.

According to another aspect of the invention, furthermore, first and second bearing members are inserted in respectively the first and second cutouts, for supporting the first and second holder cores in a rotatable manner, to constitute the at least one orientation regulator mechanism.

The first and second cutouts have respectively a pair of edges extending with an inclination relative to an inserting direction of the recording material roll. The at least one orientation regulator mechanism includes an inclined surface, formed on the first and second bearing members, inclined according to the pair of the edges, for blocking erroneous insertion of the first bearing member into the second cutout and of the second bearing member into the first cutout.

Furthermore, first and second handle members are secured to the first and second bearing members in a pivotally movable manner, set substantially erect to the first and second bearing members upon being moved up, for pushing end faces of the recording material roll, to prevent looseness of the recording material roll.

According to still another aspect of the invention, furthermore, a roll regulator mechanism pushes a pair of end faces of the recording material roll with the first and second holder cores secured thereto, to prevent looseness of the recording material roll. An unblocking mechanism releases the recording material roll from pressure of the roll regulator mechanism in response to setting of the recording material roll in the holder frame member.

Furthermore, a bias mechanism biases the roll regulator mechanism toward the end faces of the recording material roll. The unblocking mechanism moves the roll regulator mechanism away from the end faces of the recording material roll against the bias mechanism upon being set in the holder frame member.

The roll regulator mechanism includes first and second handle members, set at the first and second ends of the tubular spool shaft in a pivotally movable manner, shifted substantially erect to the first and second bearing members upon being moved up, for pushing end faces of the recording material roll.

Furthermore, first and second bearing members are secured to the holder frame member, for supporting the first and second holder cores in a rotatable manner. The first and second handle members are secured to the first and second bearing members in a pivotally movable manner, and the bias mechanism biases each of the first and second bearing members toward the recording material roll.

Furthermore, a cutout is formed through the holder frame member, has one end open at an edge of the holder frame member, for supporting each bearing member in a rotatable manner. The unblocking mechanism includes an inclined edge portion, formed at the open end of the cutout, inclined toward an inside of the holder frame member, for guiding insertion of each bearing member into the cutout. A great-diameter portion is formed at an axial end of each bearing member with a greater diameter, pushed by an edge of the cutout by insertion of each bearing members into the cutout, for sliding each bearing member away from the recording material roll.

The roll holder device is loadable in a supply magazine for a printer, and the holder frame member is disposed in the supply magazine.

According to another aspect of the invention, a supply magazine is for use with a recording material roll including a tubular spool shaft and continuous recording material wound about the tubular spool shaft in a roll form. In the supply magazine, first and second holder cores are inserted in respectively first and second ends of the tubular spool shaft. A spring plate member pushes an axial end of the first or second holder core, to position the recording material roll in an axial direction. A regulator member is disposed behind the spring plate member, for regulating a shift of the spring plate member being pushed.

Furthermore, a magazine body contains the recording material roll. A holder frame member supports the first and second holder cores in the magazine body in a rotatable member. The spring plate member and the regulator member are secured to an inner face of the magazine body.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
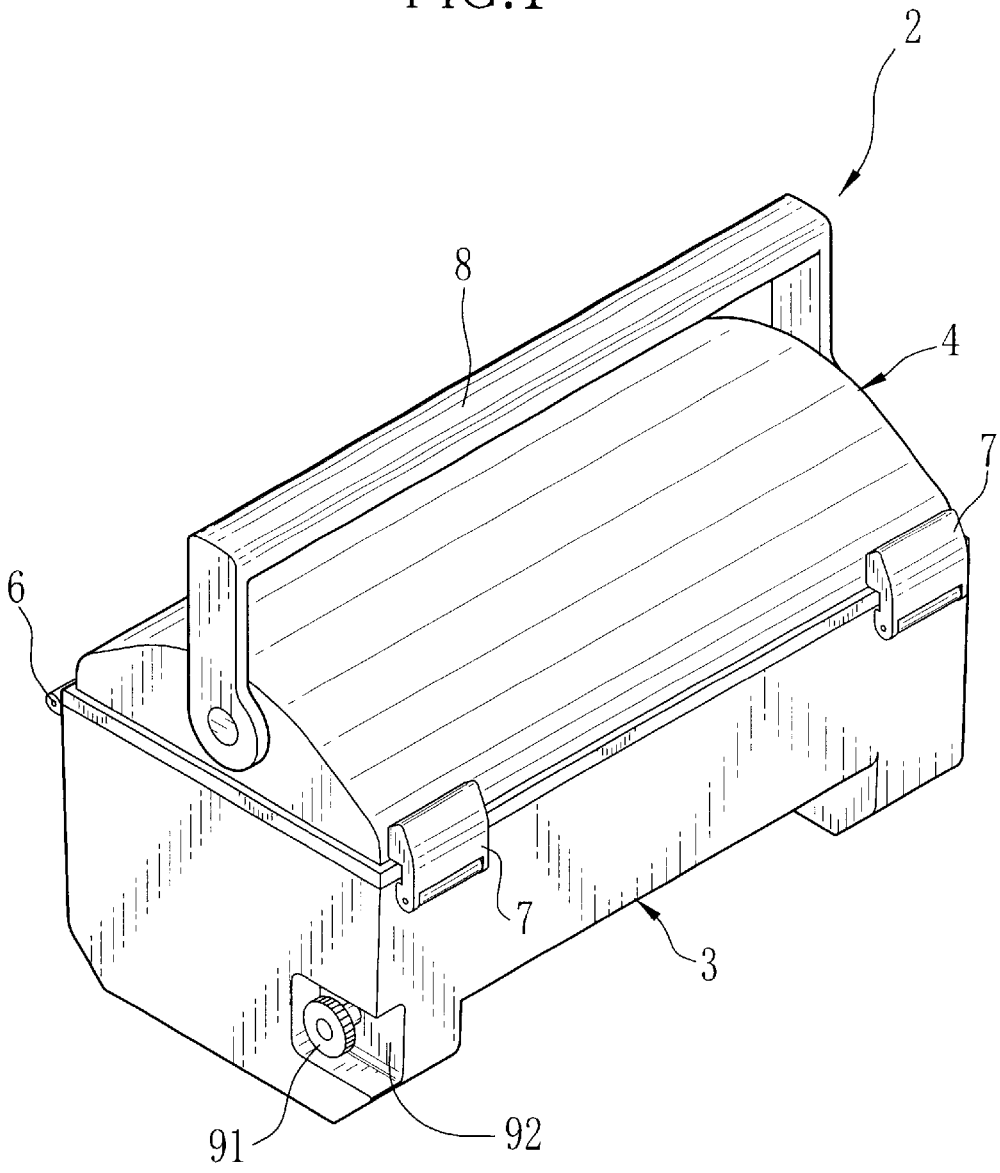
FIG. 1 is a perspective illustrating a supply magazine with a roll holder device of the invention.

In FIG. 1, appearance of a supply magazine 2 for use with a color thermal printer is illustrated. The supply magazine 2 includes a magazine body 3 and a magazine lid 4 for closing the magazine body 3 in an openable manner. Both the magazine body 3 and the magazine lid 4 are formed from plastic material having characteristics of being moisture-proof and shielding light.

A hinge 6 is disposed on a rear portion of the magazine body 3, and keeps the magazine lid 4 movable pivotally. A lock 7 is disposed in a front portion of the magazine body 3, and adapted to locking of the magazine lid 4 being closed. Packing members of rubber, elastomer or the like are secured to juncture lines of the magazine lid 4 and the magazine body 3 for tight closing of the supply magazine 2. A grip 8 is disposed on the magazine lid 4 and extends in the longitudinal direction of the supply magazine 2. The grip 8 is secured to end faces of the magazine lid 4 in a pivotally movable manner, and rotates between effective and ineffective positions, and when in the effective position, is erect to be grasped, and when in the ineffective position, is oriented horizontally after a swing in the clockwise direction. When the supply magazine 2 is set in a printer, the grip 8 is kept in the ineffective position.

Figure 2:
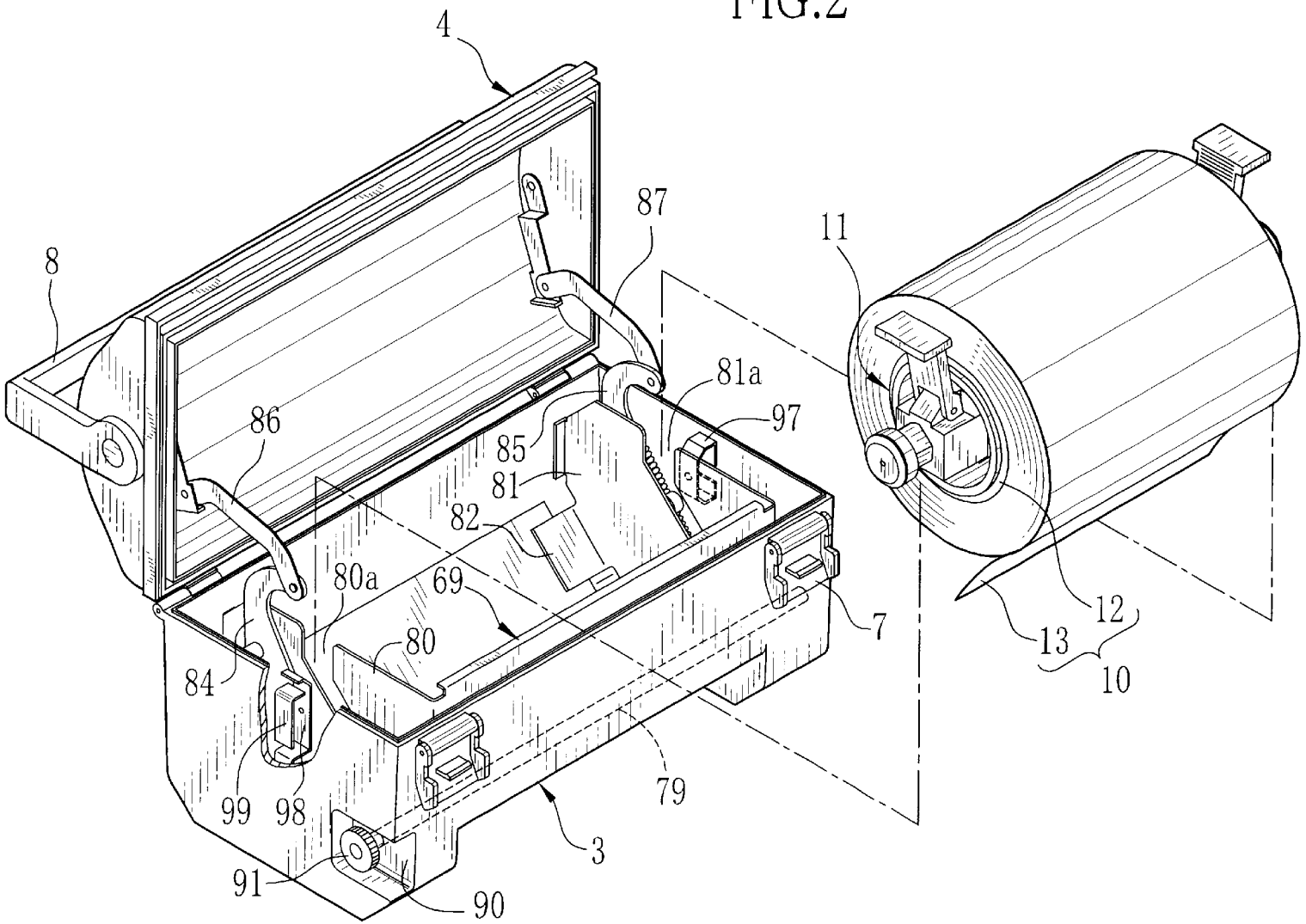
FIG. 2 is an exploded perspective illustrating the roll holder device with a recording paper roll and the supply magazine.

In FIG. 2, the supply magazine 2, a recording paper roll 10 and a roll holder device 11 are illustrated. The recording paper roll 10 as recording material roll consists of a tubular spool shaft 12 and continuous thermosensitive recording paper 13 as continuous recording material. The tubular spool shaft 12 is formed from cardboard, paper or plastic material. The recording paper 13 is wound about the tubular spool shaft 12 in a roll form. The recording paper roll 10, when unused, has a piece of adhesive tape attached to an end of the recording paper 13 to the outside of the outermost turn, to prevent looseness of the turns. A packaging bag or box is used to accommodate the recording paper roll 10, and has moisture-proof and light-shielding characteristics, so as to protect the recording paper roll 10 from influences of moisture or light. To use the recording paper roll 10, the recording paper roll 10 is removed from the package. The roll holder device 11 is fitted on ends of the tubular spool shaft 12 of the recording paper roll 10.

Figure 3:
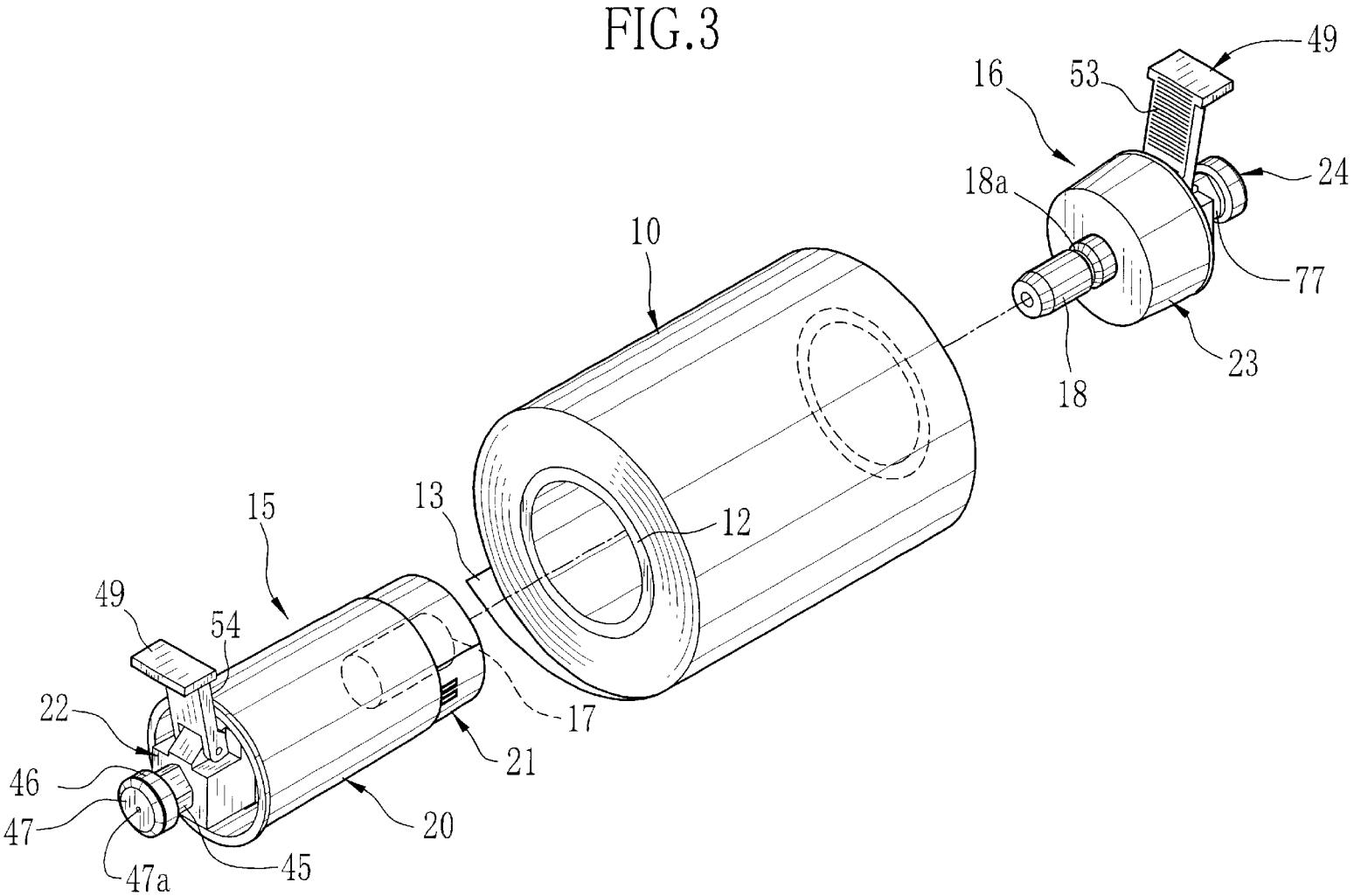
FIG. 3 is an exploded perspective illustrating the roll holder device and the recording paper roll.

In FIG. 3, the roll holder device 11 includes a longer holder component 15 and a shorter holder component 16, which is inserted in the tubular spool shaft 12 in a direction opposite to that of the longer holder component 15. A core sleeve 17 is formed with an end of the longer holder component 15. A connection shaft 18 is formed with an end of the shorter holder component 16 and inserted and engaged with the core sleeve 17.

The longer holder component 15 is a combination of a first holder core 20, an auxiliary core 21 and a first bearing assembly 22. The first holder core 20 is inserted in the end of the tubular spool shaft 12 of the recording paper roll 10 in a fitted state with sufficient tightness. The auxiliary core 21 is fitted on an axial end of the first holder core 20. The first bearing assembly 22 is disposed on a second axial end of the first holder core 20. The shorter holder component 16 includes a second holder core 23 and a second bearing assembly 24. The second holder core 23 is inserted in the end of the tubular spool shaft 12 of the recording paper roll 10 in a fitted state with sufficient tightness. The second bearing assembly 24 is disposed on an axial end of the second holder core 23.

Figure 4:
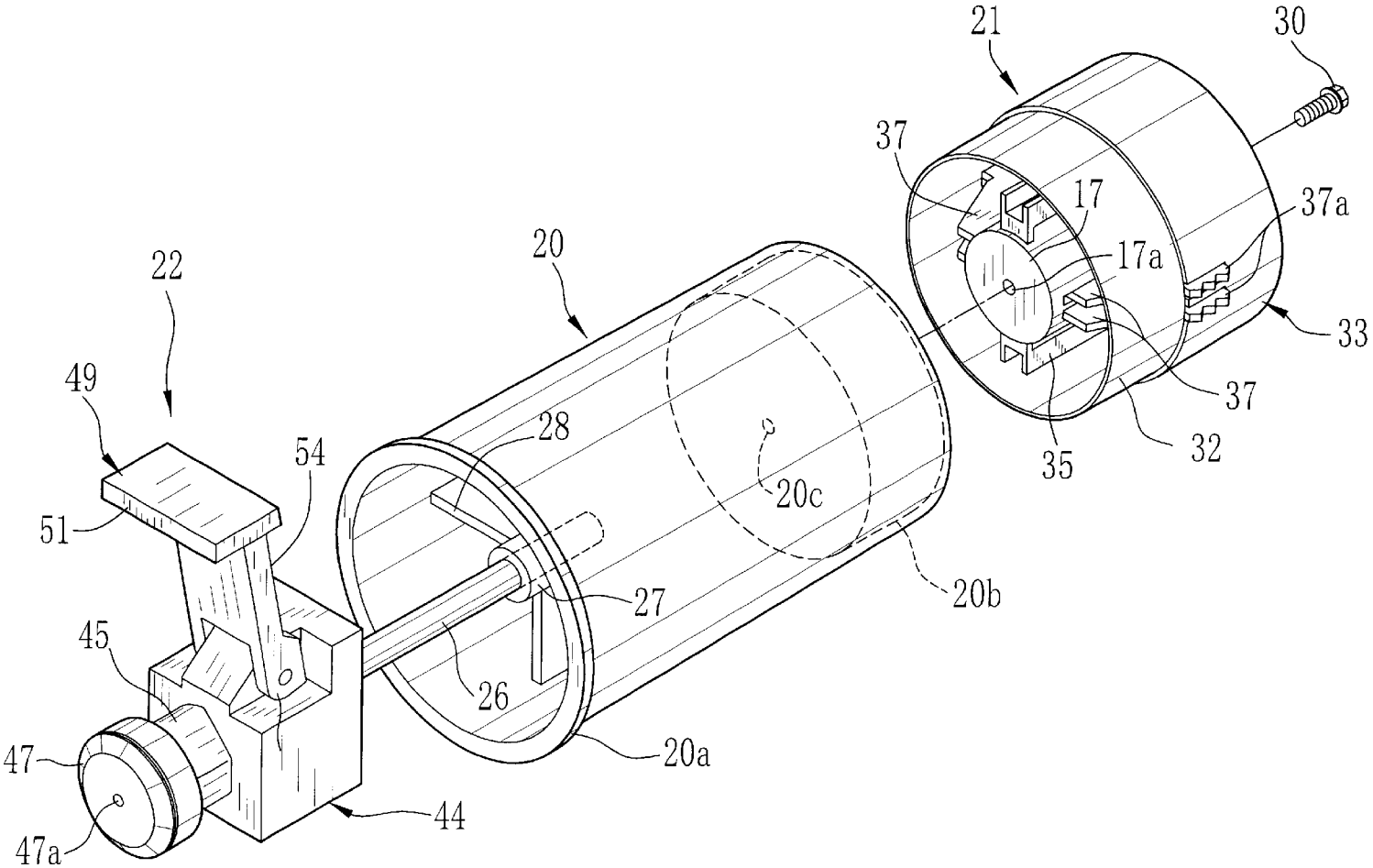
FIG. 4 is an exploded perspective illustrating a longer holder component having a first holder core, an auxiliary core and a first bearing assembly.
Figure 5:
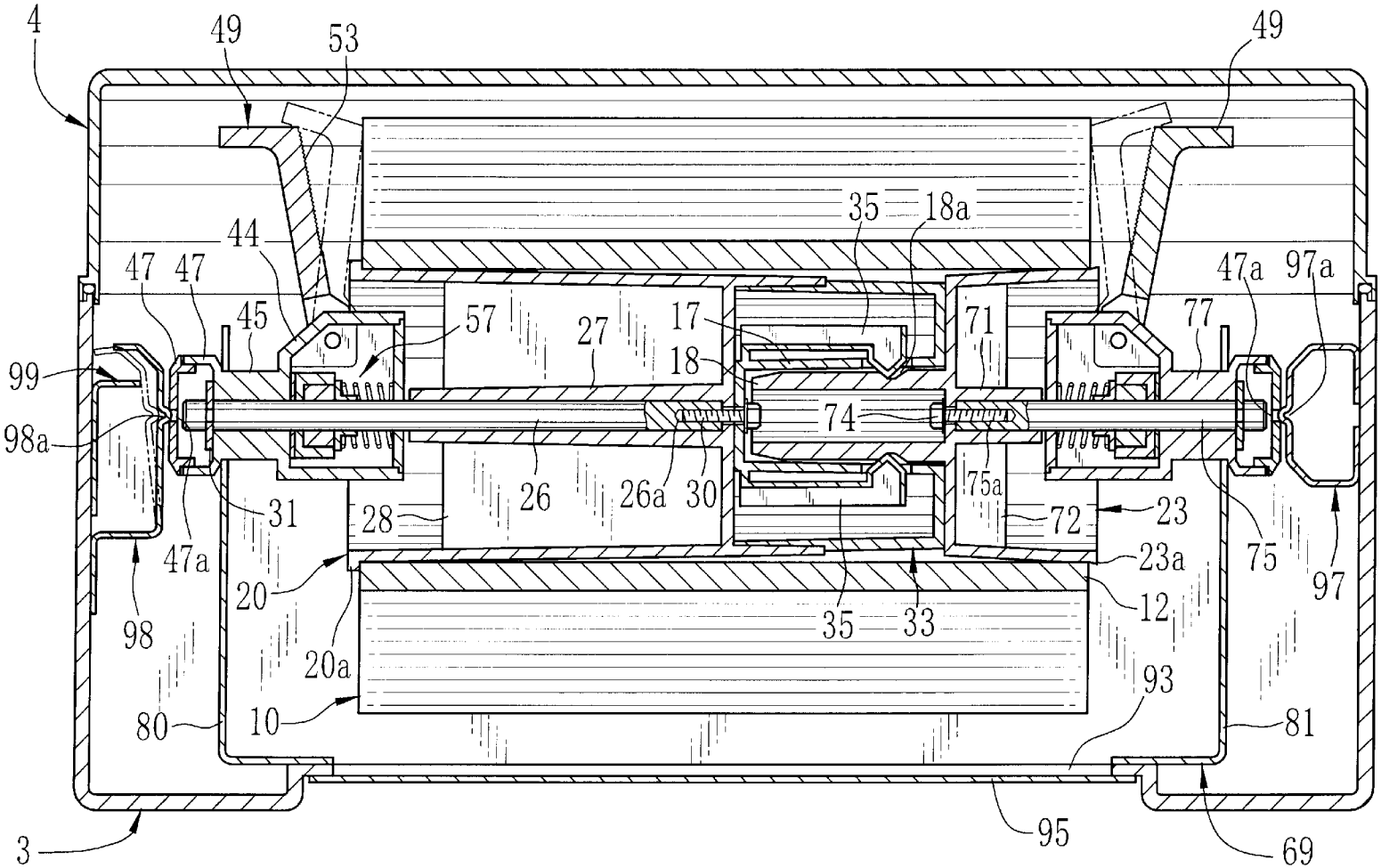
FIG. 5 is a vertical section illustrating the supply magazine with the roll holder device and the recording paper roll.

In FIGS. 4 and 5, the first holder core 20 has a substantially cylindrical shape. A flange 20*a* is formed with the first holder core 20, and contacts an end face of the tubular spool shaft 12 to position the tubular spool shaft 12 in the axial direction. A shaft sleeve 27 is disposed in the center of the first holder core 20. A rotational shaft 26 of iron is inserted in the shaft sleeve 27. Ridges 28 are arranged at an angular interval of 90 degrees, and connect the shaft sleeve 27 with the inside of the first holder core 20.

A screw hole 26*a* is formed in the end of the rotational shaft 26. A screw 30 is fastened to the screw hole 26*a*, to secure the first holder core 20 and the auxiliary core 21 to the end of the rotational shaft 26. An E-ring 31 is fitted to the second end of the rotational shaft 26 after insertion into the first bearing assembly 22 in a rotatable manner. Thus, the first holder core 20, the auxiliary core 21 and the recording paper roll 10 are rotatable together with the rotational shaft 26.

The auxiliary core 21 includes an outer cylindrical portion 33, a positioning mechanism and an anti-dropping mechanism. The outer cylindrical portion 33 includes an inner core sleeve 32 and the core sleeve 17. The inner core sleeve 32 has a smaller diameter. An outer core sleeve 20*b* is formed with the first holder core 20, and receives the inner core sleeve 32. A hole 17*a* is formed in a wall of the core sleeve 17 for insertion of the screw 30. For the same, a hole 20*c* is formed in a lower wall of the outer core sleeve 20*b*.

Figure 6:
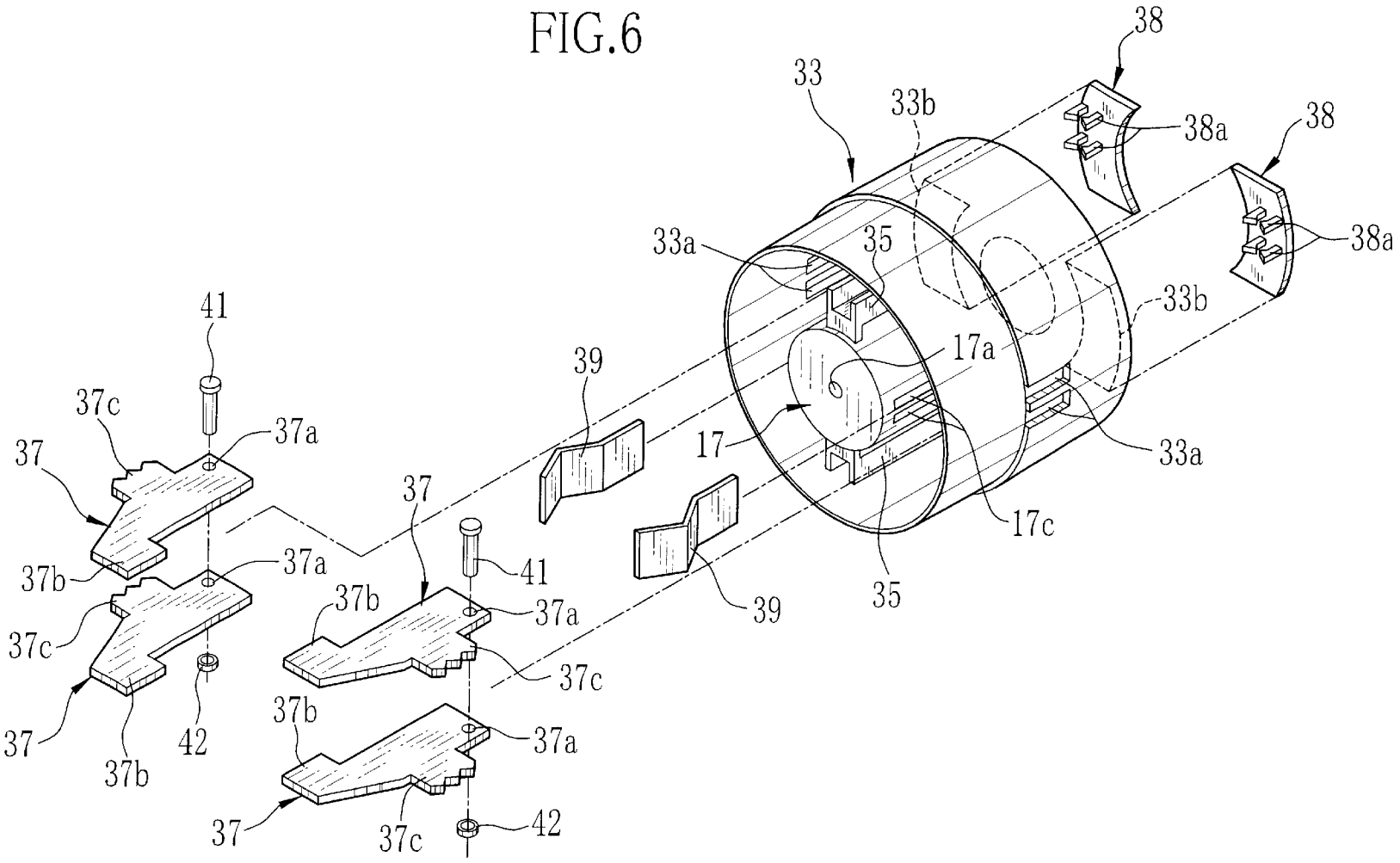
FIG. 6 is an exploded perspective illustrating an auxiliary core having anti-dropping levers.
Figure 7:
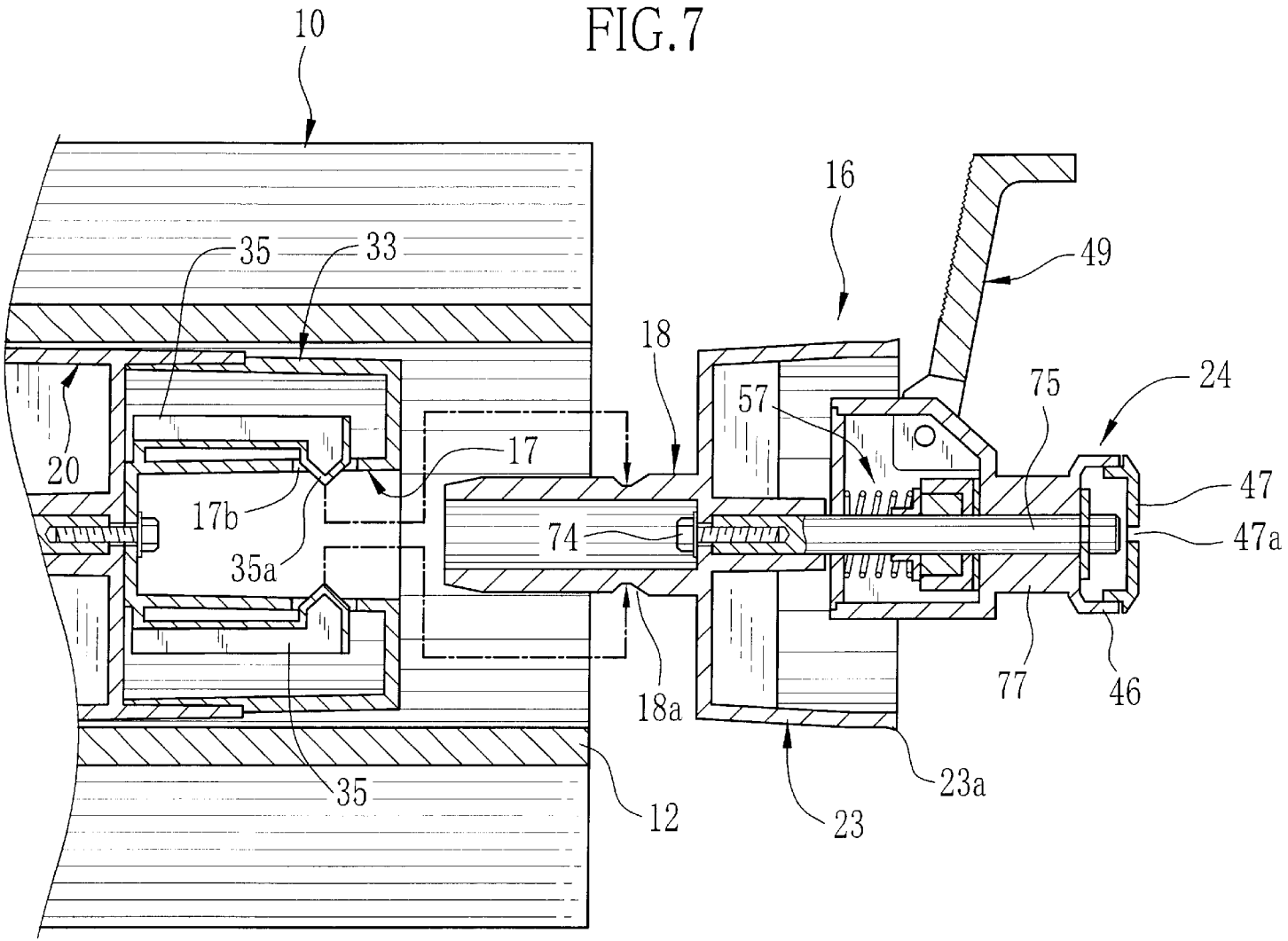
FIG. 7 is a vertical section, partially cutaway, illustrating a state before setting a shorter holder component, together with a positioning mechanism.

In FIGS. 6 and 7, a pair of latch portions 35 are formed with the outside of the core sleeve 17, and constitute a positioning mechanism. An opening 17*b* is formed in the core sleeve 17. An edge 35*a* of the latch portions 35 passes through the opening 17*b*, and projects into the core sleeve 17. A root portion of the latch portions 35 is formed with the outside of the core sleeve 17, and is deformable with resiliency. When the connection shaft 18 of the shorter holder component 16 is inserted in the core sleeve 17, the latch portions 35 are deformed. A recess 18*a* in the connection shaft 18 is engaged with the latch portions 35 for positioning in the axial direction.

Figure 8:
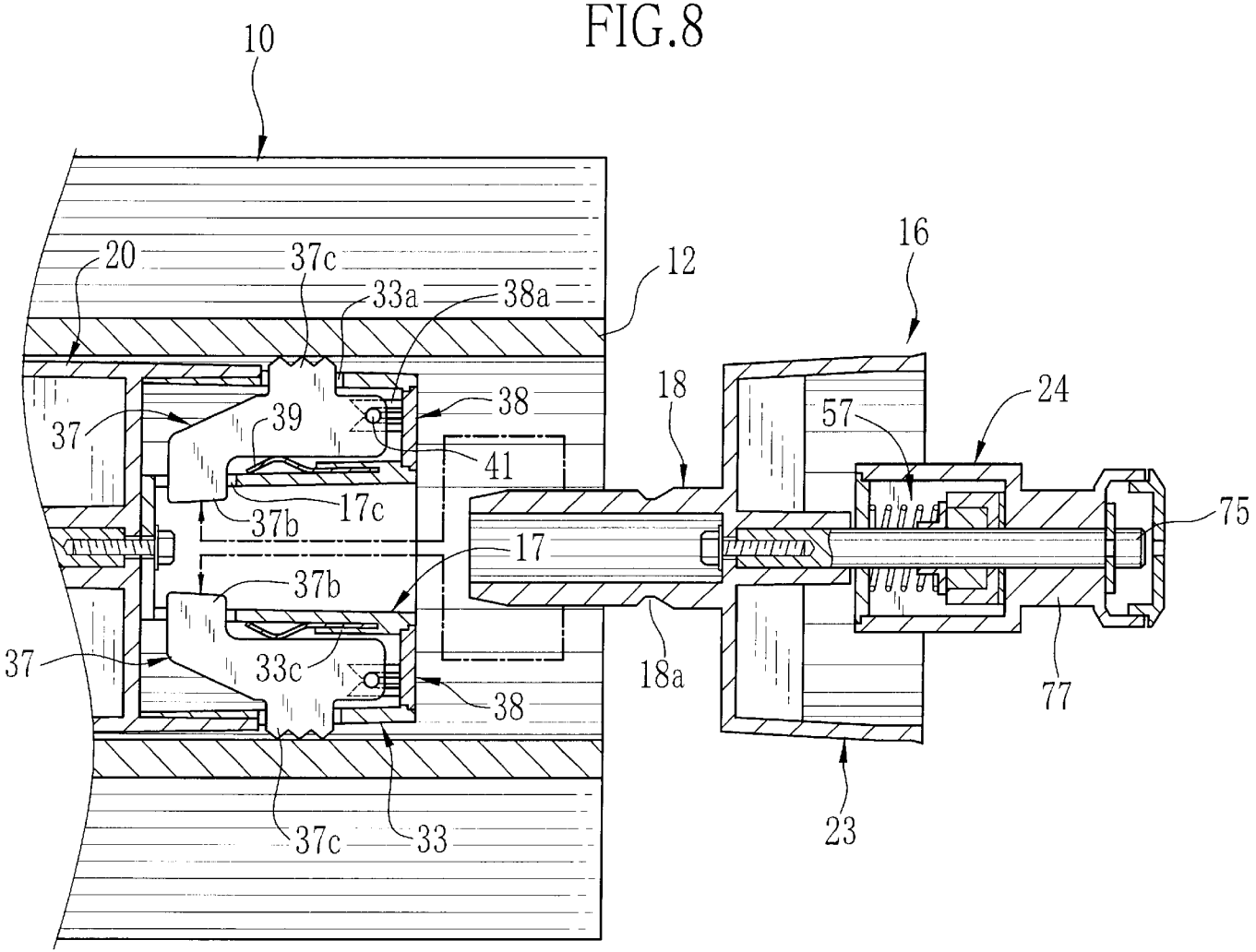
FIG. 8 is a vertical section, partially cutaway, illustrating the state before setting the shorter holder component, together with an anti-dropping mechanism.

In FIGS. 6 and 8, the anti-dropping mechanism includes four anti-dropping levers 37 as anti-dropping mechanism, support plates 38 and two plate springs 39 as bias mechanism. The anti-dropping levers 37 are accommodated in the outer cylindrical portion 33 and oriented to lie on planes that are perpendicular to the latch portions 35. The support plates 38 support the anti-dropping levers 37 in a rotatable manner. The plate springs 39 bias the anti-dropping levers 37 in a direction toward an open position.

The anti-dropping levers 37 are two pairs of thin plates of metal, and have an L-shape. A hole 37*a* is formed in the anti-dropping levers 37. A pin 41 is inserted in the hole 37*a* to support each pair of the anti-dropping levers 37 in combination. A caulking ring 42 is fitted on an end of the pin 41, and keeps the pin 41 from dropping. Openings 17*c* are formed in the core sleeve 17. Driven projections 37*b* are formed with the anti-dropping levers 37, and inserted in the openings 17*c*. Access openings 33*a* are formed in the outer cylindrical portion 33. A push surface 37*c* with claws is formed in a middle portion of the anti-dropping levers 37, and is inserted in each of the access openings 33*a*. The plural claws on the push surface 37*c* are pressed forcibly against the tubular spool shaft 12, and operate for facilitating retention to the tubular spool shaft 12.

The support plates 38 have a substantially arc shape. An arc-shaped opening 33*b* is closed by fitting each of the support plates 38 to the end face of the outer cylindrical portion 33. Support claws 38*a* are formed with the support plates 38, and squeeze and support the pin 41 which is inserted in the anti-dropping levers 37.

To connect the anti-dropping levers 37, at first the anti-dropping levers 37 with the pin 41 inserted therein are placed into the outer cylindrical portion 33. The driven projections 37*b* and the portion with the push surface 37*c* are inserted into the openings 17*c* and the access openings 33*a*. Then the support plates 38 are fitted on the end face of the outer cylindrical portion 33 to close the arc-shaped opening 33*b*. The pin 41 is squeezed by the support claws 38*a*. Thus, the anti-dropping levers 37 are kept movable pivotally.

The anti-dropping levers 37 are biased by the plate springs 39 for the push surface 37*c* to push an inner surface of the tubular spool shaft 12. Thus, the anti-dropping levers 37 fixedly retain the inner surface of the tubular spool shaft 12 while the first holder core 20 is inserted in the end of the tubular spool shaft 12, to avoid dropping of the longer holder component 15 from the core sleeve 17. A narrow gap 33*c* is formed in the outer cylindrical portion 33, and adapted to fixed securing of the plate springs 39.

Figure 9:
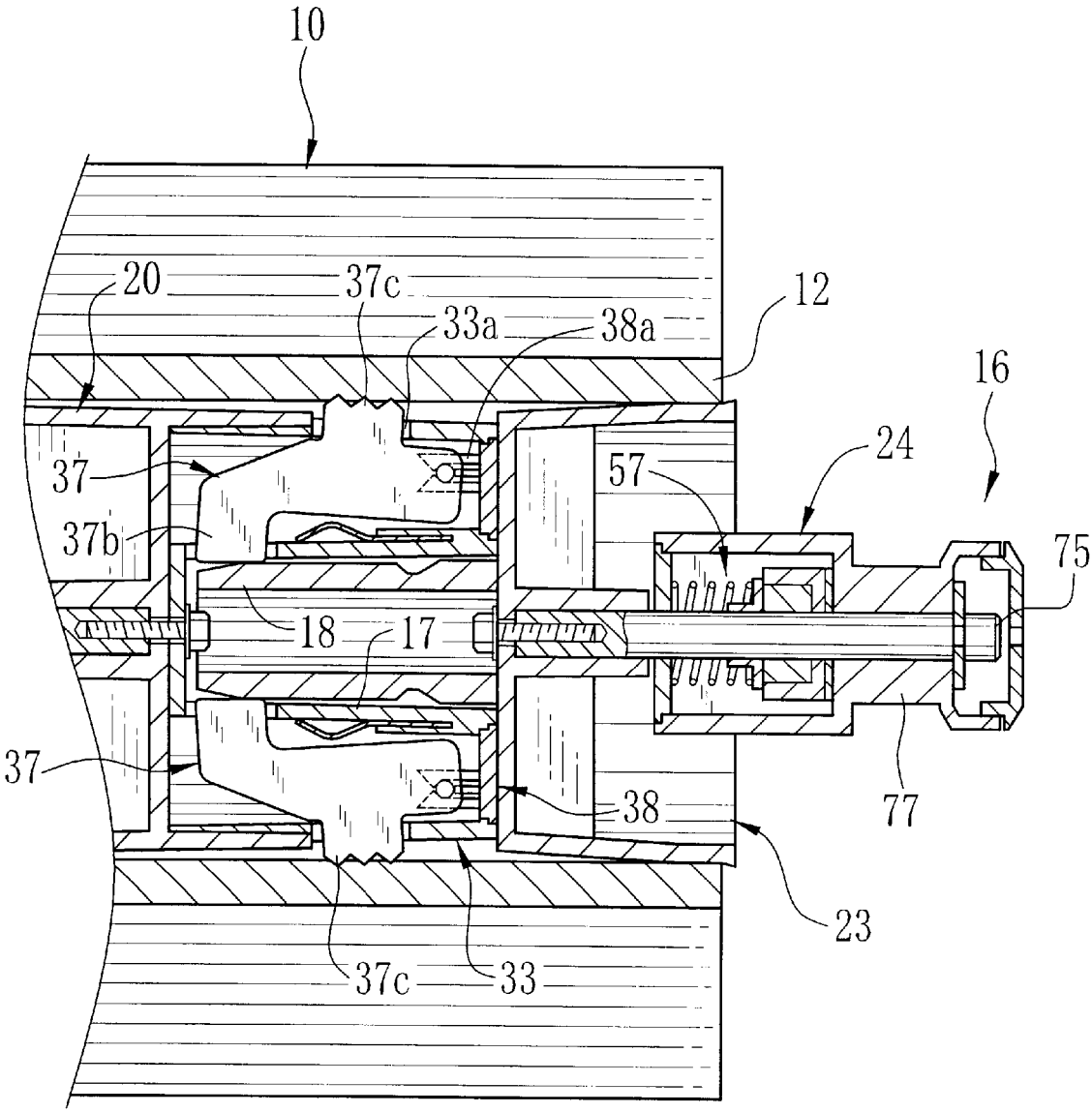
FIG. 9 is a vertical section, partially cutaway, illustrating the state upon setting the shorter holder component, together with an anti-dropping mechanism.

When the longer holder component 15 is inserted in the tubular spool shaft 12, the push surface 37*c* of the anti-dropping levers 37 is pressed against the inner surface of the tubular spool shaft 12. The anti-dropping levers 37 rotate about the center against the bias of the plate springs 39, so that the driven projections 37*b* project into the core sleeve 17. In FIG. 9, the shorter holder component 16 is inserted in the tubular spool shaft 12. The connection shaft 18 is inserted into the core sleeve 17 to push the driven projections 37*b* of the anti-dropping levers 37. Upon the push of the driven projections 37*b*, the anti-dropping levers 37 swing about the pin 41, to cause the claws of the push surface 37*c* firmly to retain the push surface 37*c* on the tubular spool shaft 12.

Consequently, the longer holder component 15 does not drop from the tubular spool shaft 12 upon securing of the shorter holder component 16 to the tubular spool shaft 12. The shorter holder component 16 does not drop from the tubular spool shaft 12 either, as the connection shaft 18 is squeezed by the anti-dropping levers 37. There occurs no slip in rotation between the longer holder component 15 and the recording paper roll 10, because the tubular spool shaft 12 is reliably fitted on the longer holder component 15.

The anti-dropping levers 37 are the two pairs disposed symmetrically with reference to the core sleeve 17. The positions and number of the anti-dropping levers 37 can be determined according to a weight of the longer holder component 15 or other various conditions.

Figure 10:
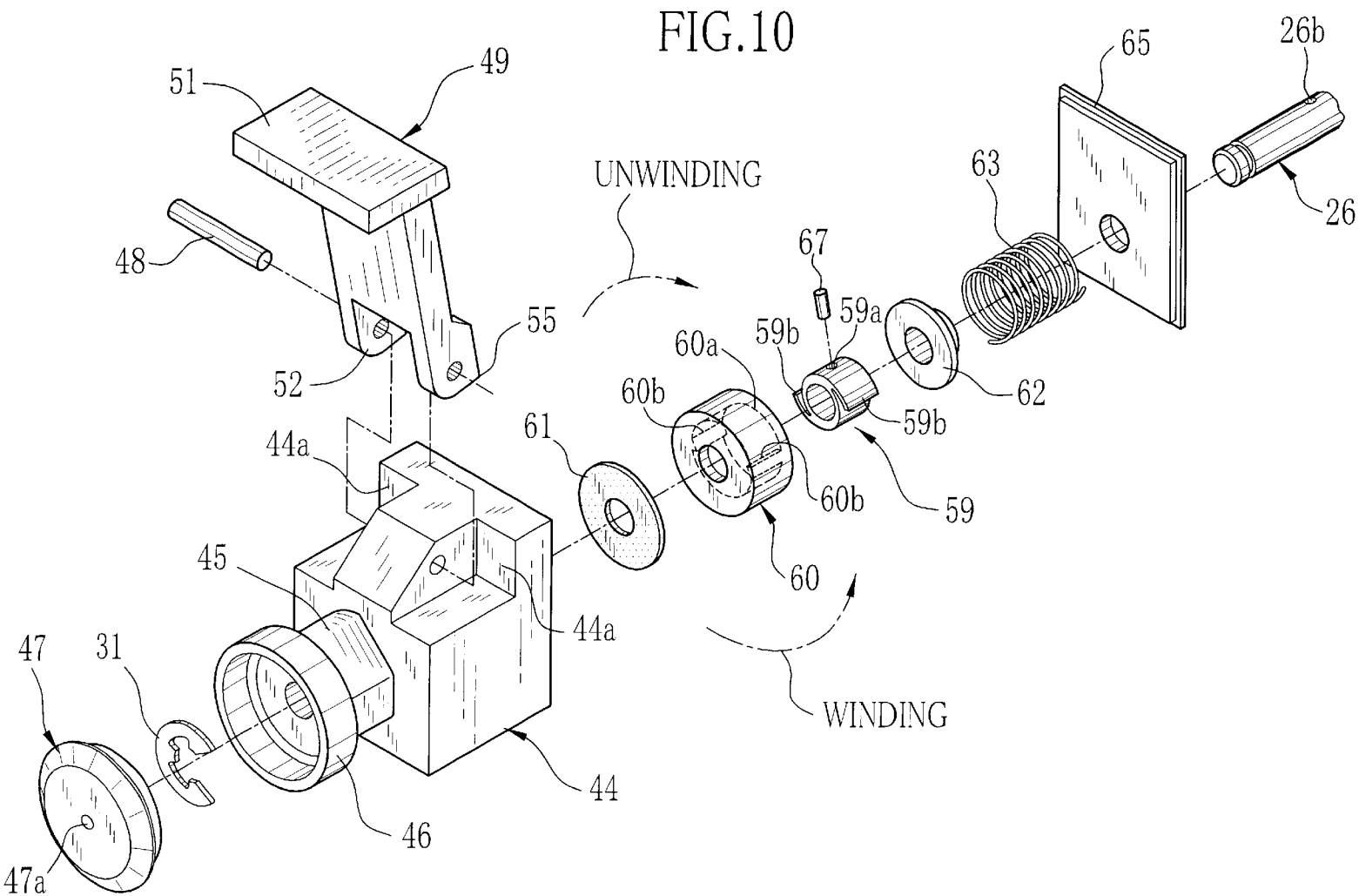
FIG. 10 is an exploded perspective illustrating a first bearing assembly.

In FIG. 10, the first bearing assembly 22 includes a case 44, an inclined bearing portion 45 as orientation regulator, a cup portion 46, a cap 47 and handles 49. The case 44 is shaped in a substantially rectangular parallelepipedon. The inclined bearing portion 45 is formed with the case 44 and supported in the supply magazine 2. The cup portion 46 is formed with the end of the inclined bearing portion 45. The cap 47 is fitted in the cup portion 46. Also, a pin 48 keeps the handles 49 movable pivotally on the case 44.

Figure 11:
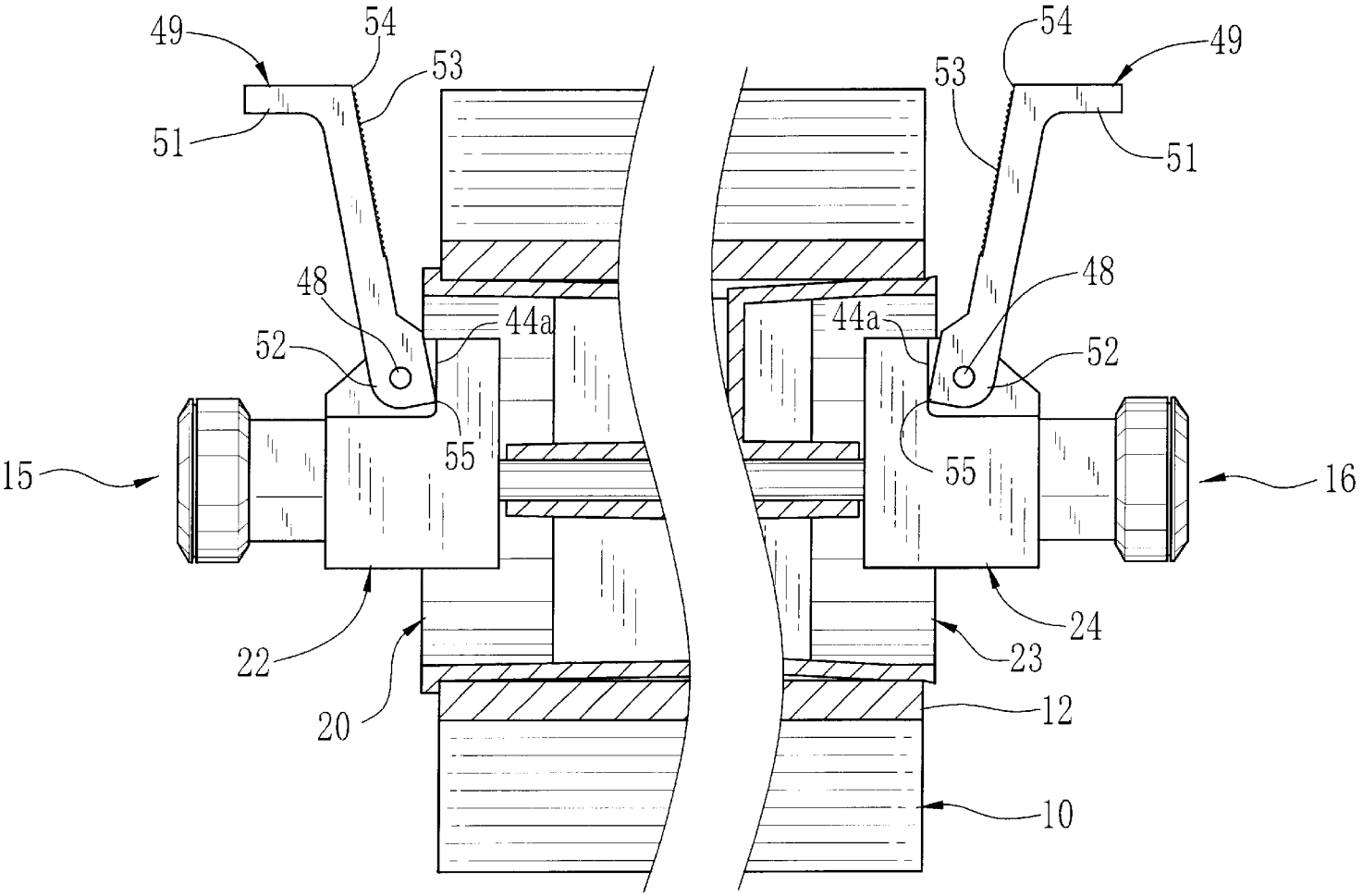
FIG. 11 is a vertical section, partially cutaway, illustrating a state before handles are set on the recording paper roll.

In FIG. 11, the handles 49 have an L-shape as viewed in section, and include a handle portion 51 at an upper end and arms 52 at a lower end. The handle portion 51 is grasped for manually raising the recording paper roll 10. The arms 52 are rotatable on the case 44. A contact surface 54 is formed in the handles 49, and extends along a longer side of the handles 49. Plural ridges 53 are formed on the contact surface 54, extend horizontally, and have a small height. A ridge portion 55 is formed with the arms 52 of the handles 49, and opposed to the recording paper roll 10. A vertical surface 44*a* of the case 44 is contacted by the ridge portion 55, and prevents the handles 49 from swinging beyond a predetermined angular position.

When the recording paper roll 10 is mounted in the roll holder device 11, the handles 49 are in an open state. A user's hands grasp the handle portion 51 of the handles 49 and raise the recording paper roll 10, so the handles 49 rotate in directions toward the recording paper roll 10. See FIG. 12. The contact surface 54 comes in contact with end faces of the recording paper roll 10. The ridges 53 in the contact surface 54 are forcibly thrust into the end faces of the recording paper roll 10, and prevent the recording paper roll 10 from being loosened. Note that the ridges 53 do not influence the recording paper roll 10, as the ridges 53 have only a small height.

The contact surface 54 of the handles 49 does not become parallel with the end face of the recording paper roll 10, and only comes in contact with the outermost turn of the recording paper roll 10. However, the regulation of the contact surface 54 for the outermost turn against looseness is effective in preventing inner turns of the recording paper roll 10. Also, influence of the ridges 53 to the recording paper roll 10 is kept small.

A one-way clutch 57 as load changer mechanism is accommodated in the case 44, for changing over rotational load according to rotational directions of the recording paper roll 10. As illustrated best in FIGS. 5, 10, 13A and 13B, the one-way clutch 57 is provided with a ratchet wheel 59 or cam wheel, a tube 60, a friction pad 61, a bias disk 62 and a coil spring 63. The ratchet wheel 59 is secured to the rotational shaft 26 and rotates together with the same. A cylindrically shaped chamber 60*a* is formed in the tube 60, and contains the ratchet wheel 59. The friction pad 61 is a felt member, and contacts the end face of the tube 60. The bias disk 62 has a flange, and contacts an end face of the tube 60 opposite to the friction pad 61. The coil spring 63 contacts the bias disk 62 to push the tube 60 against the friction pad 61. A lid 65 is secured to the case 44 to enclose the same after those elements in the one-way clutch 57 are contained in the case 44.

Note that the friction pad 61 may consist of any frictional material such as fabric, non-woven fabric, polyurethane foam or the like.

A hole 59*a* is formed in a peripheral wall of the ratchet wheel 59. A pin 67 is inserted in the ratchet wheel 59. Also, a hole 26*b* is formed in the rotational shaft 26 for insertion of the pin 67. Thus, the ratchet wheel 59 is secured to the rotational shaft 26 and rotatable together. Two resilient ratchet claws 59*b* or ridges project in the clockwise direction from the periphery of the ratchet wheel 59, and are rotationally symmetrical to each other. Two teeth 60*b* are formed with the inner face of the chamber 60*a* of the tube 60 in a rotationally symmetrical manner.

When the rotational shaft 26 rotates in the unwinding direction clockwise in the drawing, the ratchet wheel 59 rotates together. The ratchet claws 59*b* contact, and become engaged with, the teeth 60*b* of the tube 60. The tube 60 rotates with the ratchet wheel 59. An end face of the tube 60 frictionally contacts the friction pad 61. Rotational load of the rotational shaft 26 or the recording paper roll 10 increases, to apply back tension to the recording paper 13 being fed. This is effective in keeping stability in the feeding, and preventing occurrence of oblique movement or jamming.

In contrast, when the rotational shaft 26 rotates in the winding direction that is counterclockwise, then the ratchet wheel 59 rotates together. The ratchet claws 59*b* are deformed resiliently upon contact with the teeth 60*b* of the tube 60, and readily move past the teeth 60*b*. Thus, the tube 60 does not rotate. Rotational load of the rotational shaft 26 or of the recording paper roll 10 decreases. Therefore, occurrence of looseness of the turns is prevented by absorbing a difference in the rotational speed between a middle turn and the outermost turn of the recording paper roll 10.

Figure 15:
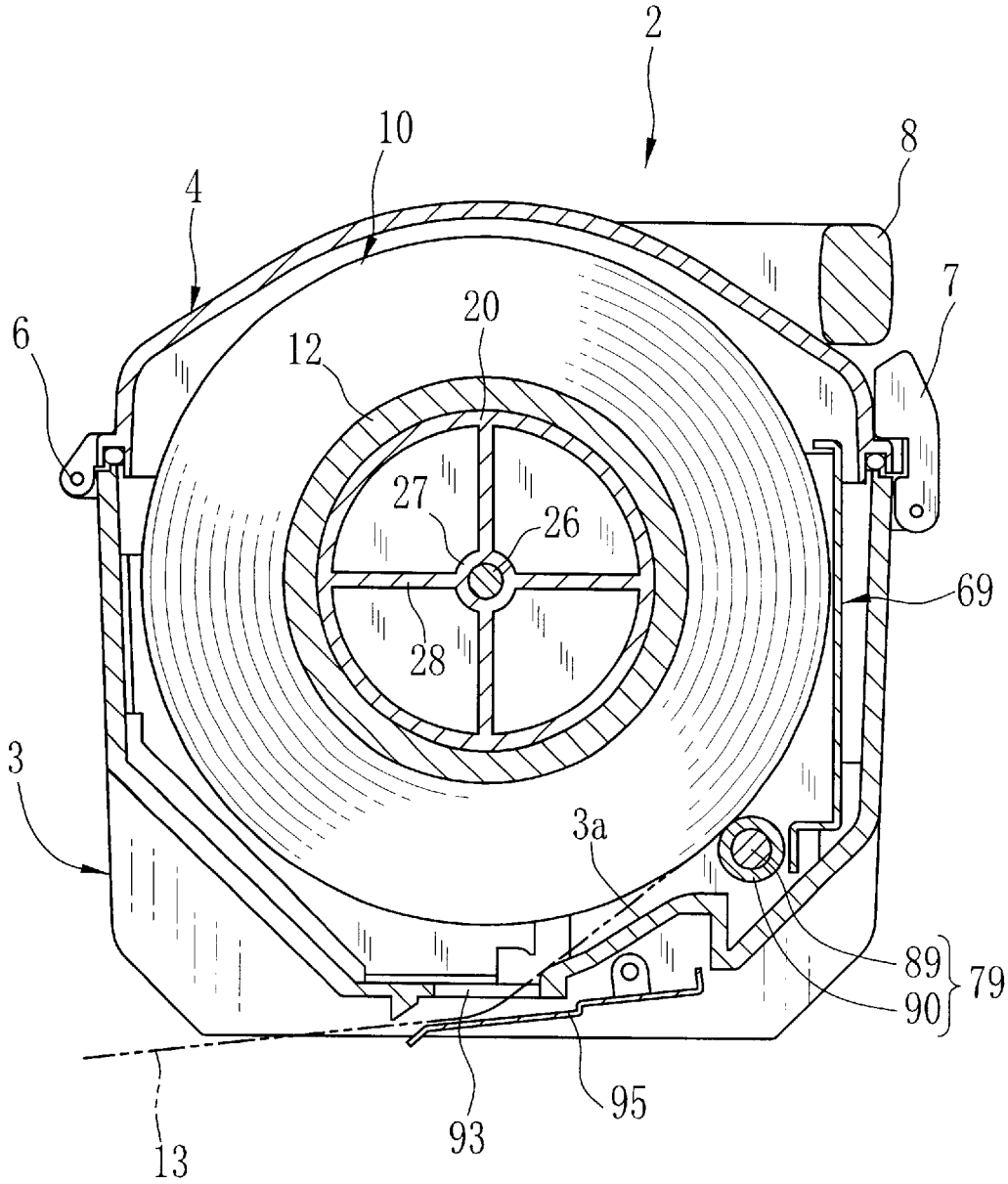
FIG. 15 is a cross section illustrating the supply magazine, the roll holder device and the recording paper roll.

In FIG. 15, a shape of the inclined bearing portion 45 as viewed in section is obtained by cutting away two portions from a circle along two parallel straight lines, and by forming an angular edge at the lower edge instead of the arc. The inclined bearing portion 45 has surfaces inclined with reference to the horizontal direction. A holder frame or support frame 69 is contained in the supply magazine 2, and supports the inclined bearing portion 45. The inclined bearing portion 45 is also used for checking a direction of the recording paper roll 10 in the course of being set into the supply magazine 2.

A hole 47*a* is formed in an end wall of the cap 47. When the recording paper roll 10 with the roll holder device 11 is set in the supply magazine 2, the hole 47*a* is used for positioning the recording paper roll 10 in the axial direction.

The second holder core 23 of the shorter holder component 16 has a form defined by shortening the first holder core 20 in the axial direction. There are a shaft sleeve 71 and ridges 72 in the second holder core 23. A flange 23*a* is formed with the rear end of the second holder core 23, has a small protruding amount, has a tapered shape, and contacts an edge of the end face of the tubular spool shaft 12.

The flange 23*a* in the shorter holder component 16 is small, because the flange 23*a* should be so disposed as to uncover marks or indicia which are disposed on an end face of the tubular spool shaft 12 located at the shorter holder component 16 to represent information of various kinds related to the recording paper 13. There is a sensor or reader in the supply magazine 2 for reading the tubular spool shaft 12. A detection signal from the sensor is input to a printer, and decoded and used as information of the recording paper 13.

The connection shaft 18 has a tubular shape. A screw 74 is inserted through the inside of the connection shaft 18. A screw hole 75*a* is formed in an end of a rotational shaft 75. The screw 74 is fastened to the screw hole 75*a* through the second holder core 23. Thus, the second holder core 23 is fixed to the rotational shaft 75 and rotatable together with the same.

The second bearing assembly 24 in the shorter holder component 16 is structurally the same as the first bearing assembly 22 in the longer holder component 15. Elements similar to those of the first bearing assembly 22 are designated with identical reference numerals. An inclined bearing portion 77 as orientation regulator has a shape equal to that of the inclined bearing portion 45 in the first bearing assembly 22 as viewed horizontally. Thus, the case 44 has an inverted shape with reference to the inclined bearing portion 45.

Figure 16:
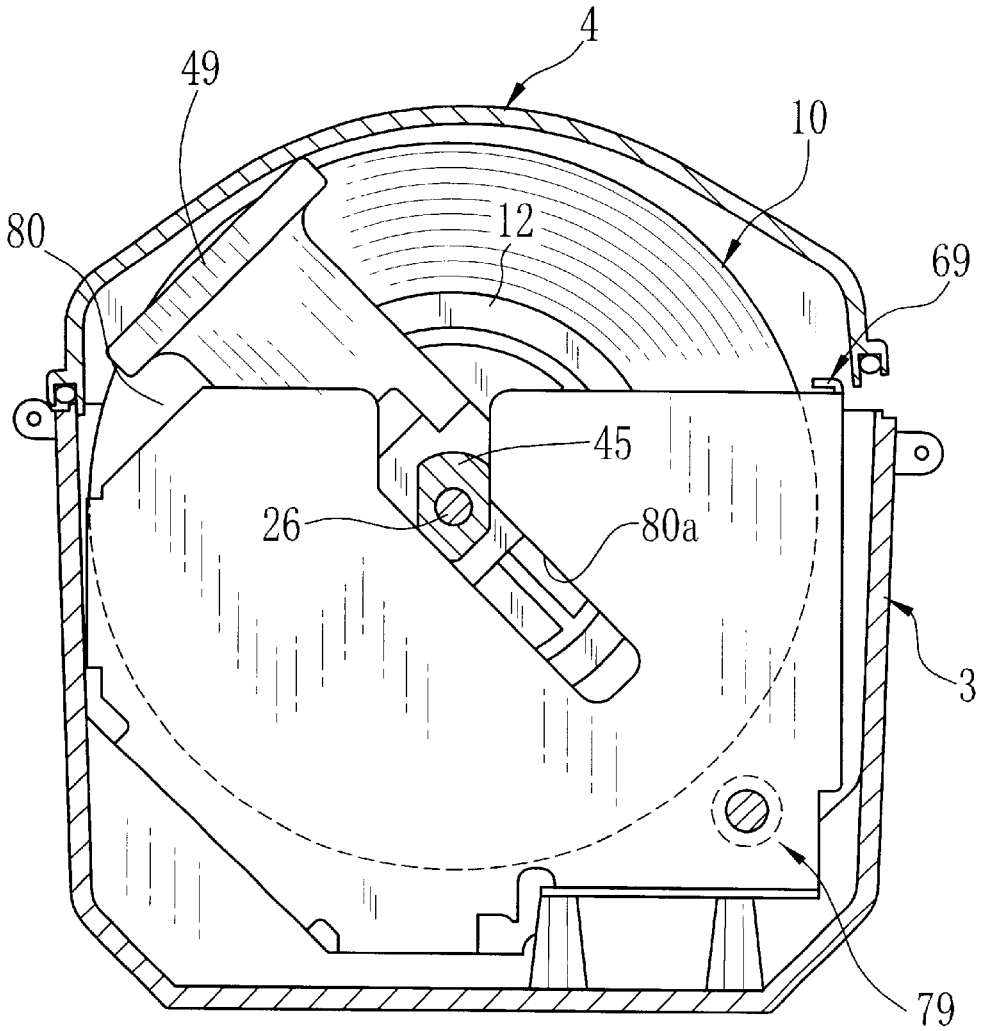
FIG. 16 is a side elevation illustrating an inappropriate state of setting each bearing assembly in a cutout.

In FIGS. 2, 5 and 16, the holder frame 69 in the supply magazine 2 supports the roll holder device 11 on which the recording paper roll 10 is fitted. Also, a supply roller 79 is accommodated in the supply magazine 2. The holder frame 69 is formed by cutting and flexing a plate of metal with a small thickness. Frame walls 80 and 81 in the holder frame 69 are erect vertically in the magazine body 3. A fixation wall 82 in the holder frame 69 is fixed to the magazine body 3.

Cutouts 80*a* and 81*a* or slits are formed in respectively the frame walls 80 and 81 for insertion of the first and second bearing assemblies 22 and 24 of the longer and shorter holder components 15 and 16. Each of the cutouts 80*a* and 81*a* includes vertical edges and inclined edges connected with lower ends of the vertical edges. The vertical edges allow setting of the recording paper roll 10 from a position above the magazine body 3. The inclined edges are inclined toward the supply roller 79, and guide the recording paper roll 10 in such a manner that, when an outer diameter of the recording paper roll 10 decreases in using the recording paper 13, an outer turn of the recording paper roll 10 contacts the supply roller 79. The inclination of the inclined bearing portions 45 and 77 is predetermined according to that of the inclined edges of the cutouts 80*a* and 81*a*.

Unidirectional positioning plates 84 and 85 are secured to respectively the frame walls 80 and 81 for pressing the recording paper roll 10 against the supply roller 79. The positioning plates 84 and 85 have one end secured to the frame walls 80 and 81 in a rotatable manner, and biased by a spring in a direction to contact the cup portion 46 of the roll holder device 11. The positioning plates 84 and 85 push the cup portion 46 to move the recording paper roll 10 along the cutouts 80*a* and 81*a* in the frame walls 80 and 81. Thus, the outermost turn of the recording paper roll 10 is kept in contact with the supply roller 79. There are connector levers 86 and 87 for connecting ends of the positioning plates 84 and 85 to the magazine lid 4. When the magazine lid 4 is moved in the opening direction, the positioning plates 84 and 85 move to open the cutouts 80*a* and 81*a*. When the magazine lid 4 is moved in the closing direction, the positioning plates 84 and 85 contact the roll holder device 11.

When the recording paper roll 10 with the roll holder device 11 is set in the supply magazine 2, the inclined bearing portions 45 and 77 are inserted in respectively the cutouts 80*a* and 81*a*. If the recording paper roll 10 is appropriately oriented, the inclined bearing portions 45 and 77 can enter the inclined section of the cutouts 80*a* and 81*a* after passing the vertical section. See FIG. 15. Thus, propriety in the orientation of the recording paper roll 10 or the roll holder device 11 is confirmed.

If the direction of setting the recording paper roll 10 is wrong, the inclinations of the inclined bearing portions 45 and 77 are opposite to those of the cutouts 80*a* and 81*a*. When a user tries forcibly to push the inclined bearing portions 45 and 77 into the cutouts 80*a* and 81*a*, the recording paper roll 10 comes to interfere with the magazine body 3. This situation easily makes the user aware of the impropriety in the direction.

Although the recording paper roll 10 improperly oriented is accommodated in the magazine body 3 as illustrated in FIG. 16 by rotating the recording paper roll 10 forcibly, a user can be informed of the impropriety, because the inclined bearing portions 45 and 77 cannot enter the inclined section of the cutouts 80*a* and 81*a*, and also because of an inclination of the handles 49, and impossibility in closing the magazine lid 4.

The supply roller 79 includes a rotational shaft 89 and a roll 90. The rotational shaft 89 is supported on the holder frame 69 in a rotatable manner. The roll 90 is secured about the rotational shaft 89. The roll 90 is formed from material of high friction, such as rubber, for reliable transmission of rotation of the recording paper roll 10. A recess 92 is formed in an end wall of the magazine body 3. One end of the rotational shaft 89 projects into the recess 92. A transmission gear 91 is secured to the end of the rotational shaft 89. When the supply magazine 2 is set in a printer, an output gear of a drive mechanism in the printer comes in mesh with the transmission gear 91, which is rotated for feeding. Thus, the recording paper roll 10 meshed with the supply roller 79 is rotated, to feed the recording paper 13 through a supply passageway 93, which is formed in a lower wall of the magazine body 3.

An openable lid 95 closes the supply passageway 93 in a normal state, as biased by a spring in a direction for closing the supply passageway 93. When the supply magazine 2 is set in a printer, the openable lid 95 is rotated by a mechanism in the printer to open the supply passageway 93.

An inner wall of the magazine body 3 opposed to an end face of the roll holder device 11 is provided with a contact plate 97, a spring plate 98 and a regulator plate 99. In FIG. 5, the contact plate 97 is formed by bending a thin plate of metal in a trapezoidal shape, and is disposed in a position opposed to an end face of the shorter holder component 16 at the time directly after setting the recording paper roll 10. A projection 97*a* is formed in a front face of the contact plate 97, fitted in the hole 47*a* in the end face of the shorter holder component 16, and positions the shorter holder component 16 in the axial direction.

The spring plate 98 is a plate of metal bent in a crank shape, and secured in a position opposed to an end face of the longer holder component 15 at the time immediately after setting the recording paper roll 10. A projection 98*a* is formed on a front face of the spring plate 98, and engageable with the hole 47*a* in the longer holder component 15, and pushes the longer holder component 15 for positioning in the axial direction.

If the recording paper roll 10 is set in the supply magazine 2 with the shorter holder component 16 improperly fitted on the longer holder component 15, then the spring plate 98 is depressed and deformed. According to the prior art, a resilient member or spring plate is kept deformed so that the recording paper roll 10 is deviated in the width direction. However, the regulator plate 99, according to the invention, is disposed behind the spring plate 98 to avoid deformation beyond a predetermined limit. Thus, the spring plate 98 and the contact plate 97 can cooperate to push the longer and shorter holder components 15 and 16 and thrust those into the tubular spool shaft 12. The recording paper roll 10 is set properly without being offset in the width direction.

The operation of the above embodiment is described now. The recording paper roll 10 is removed from the packaging bag at first. In FIG. 3, the first holder core 20 of the longer older component 15 is inserted in one end of the tubular spool shaft 12. In FIG. 8, the anti-dropping levers 37 at an end of the first holder core 20 are pushed by the plate springs 39 to cause the push surface 37*c* to protrude from the access openings 33*a*, and contact an inner surface of the tubular spool shaft 12. Therefore, there occurs no drop of the longer holder component 15 from the recording paper roll 10 upon fitting the longer holder component 15 on the recording paper roll 10.

Then the second holder core 23 of the shorter holder component 16 is inserted in the opposite end opening of the recording paper roll 10. In FIG. 7, the connection shaft 18 in the shorter holder component 16 enters the core sleeve 17 of the longer holder component 15. The latch portions 35 are deformed resiliently and become engaged with the recess 18*a* to position the shorter holder component 16 in the axial direction. Also, this engagement with a click makes a user clearly aware that the shorter holder component 16 has become engaged with the longer holder component 15.

In FIG. 9, the connection shaft 18 pushes the driven projections 37*b* of the anti-dropping levers 37. During the push, the push surface 37*c* of the anti-dropping levers 37 is shifted out of the access openings 33*a* and firmly retains the inner surface of the tubular spool shaft 12. This is effective in tightening retention between the recording paper roll 10 and the longer holder component 15. Also, force of repulsion of the tubular spool shaft 12 causes the anti-dropping levers 37 to squeeze the connection shaft 18. There occurs accidental drop of the connection shaft 18 from the recording paper roll 10.

The supply magazine 2 disengages the lock 7 from the magazine lid 4, which is rotated about the hinge 6 to open a top of the magazine body 3. Upon the opening movement of the magazine lid 4, the positioning plates 84 and 85 are moved to open an upper portion of the cutouts 80*a* and 81*a*. In FIG. 2, the holder frame 69 inside the magazine body 3 is uncovered.

Figure 12:
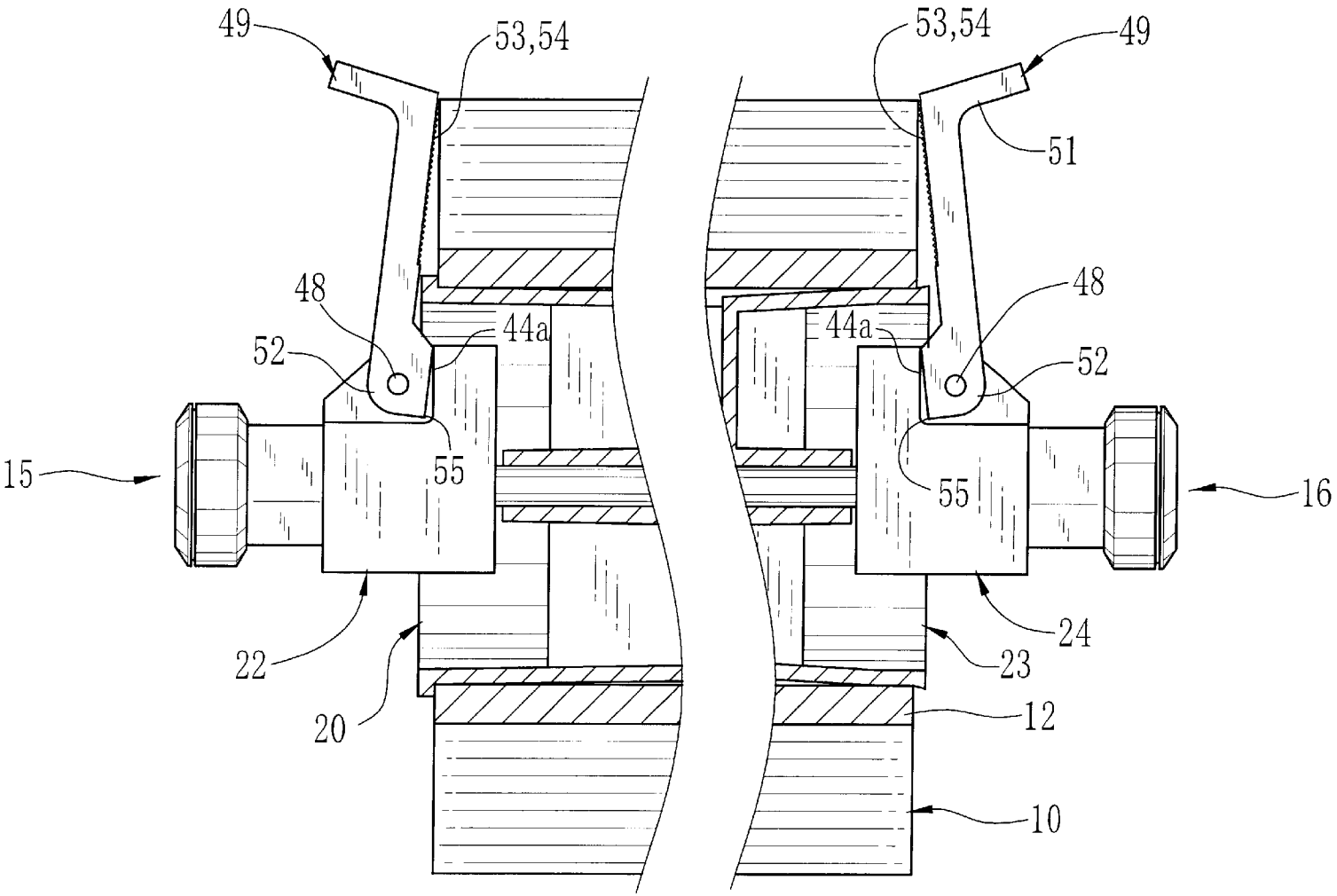
FIG. 12 is a vertical section, partially cutaway, illustrating a state upon setting handles on the recording paper roll.

To raise the recording paper roll 10 manually, a user's hands grasp the handle portion 51 of the handles 49 in the roll holder device 11. Thus, the recording paper roll 10 can be protected from occurrence of fingerprints or influence of various kinds. In FIG. 12, grasping of the handles 49 with two hands causes the weight of the recording paper roll 10 to swing the handles 49. The contact surface 54 is pressed against each of the end faces of the recording paper roll 10. The ridges 53 become thrust in the end faces shallowly. Thus, loosening of the recording paper roll 10 can be prevented. Also, turns of the recording paper roll 10 can be neatened without unevenness in a shape of a cone.

To set the recording paper roll 10 with the roll holder device 11 into the supply magazine 2, the inclined bearing portions 45 and 77 are inserted into the cutouts 80*a* and 81*a*. If a direction of setting the recording paper roll 10 is appropriate, then the inclined bearing portions 45 and 77 enter the inclined section of the cutouts 80*a* and 81*a* after passing their vertical section. The inclined bearing portions 45 and 77 are finally set in a lower position of the inclined bearing portions 45 and 77. See FIG. 15.

If the direction of setting the recording paper roll 10 is wrong, the inclinations of the inclined bearing portions 45 and 77 are directed opposite to those of the cutouts 80*a* and 81*a*, to block insertion into the cutouts 80*a* and 81*a*. If force is applied to insert the inclined bearing portions 45 and 77 into the cutouts 80*a* and 81*a* against the resistance, the recording paper roll 10 comes to interfere with the magazine body 3.

If the recording paper roll 10 is set in an inappropriate direction, the recording paper roll 10 could be inserted in the magazine body 3 by rotation of the recording paper roll 10 to a small extent. See FIG. 17. However, the inclined bearing portions 45 and 77 do not enter the inclined section of the cutouts 80*a* and 81*a*. The handles 49 are inclined. The magazine lid 4 cannot be closed. Consequently, the user is caused immediately to find impropriety in the direction of the recording paper roll 10. It is possible to set the recording paper roll 10 correctly before the supply magazine 2 is set in a printer.

In the course of containing the recording paper roll 10 into the magazine body 3, the contact plate 97 and the spring plate 98 on the inner walls of the magazine body 3 come in contact with end faces of the shorter holder component 16 and the longer holder component 15. The projections 97*a* and 98*a* become engaged with the hole 47*a* to position the recording paper roll 10 in the axial direction.

Note that, if the recording paper roll 10 is set in the supply magazine 2 in a very loose state of the longer and shorter holder components 15 and 16 in the recording paper roll 10, the spring plate 98 is pressed and deformed resiliently. However, the regulator plate 99 prevents the spring plate 98 from deformation beyond a required amount. The longer and shorter holder components 15 and 16 are pushed into the tubular spool shaft 12. Therefore, the recording paper roll 10 is kept from being offset in the axial direction.

After setting the recording paper roll 10, the magazine lid 4 is closed. The lock 7 is operated to lock the magazine lid 4. The recording paper roll 10 is biased by the positioning plates 84 and 85 and is moved along inner edges of the cutouts 80*a* and 81*a*. So the recording paper roll 10 comes in contact with the supply roller 79. In FIG. 11, the handles 49 are caused by the weight of themselves to move to an open position, and do not have influence to the recording paper roll 10.

When the supply magazine 2 with the recording paper roll 10 is set in the color thermal printer, the output gear of the drive mechanism in the printer is meshed with the transmission gear 91 of the supply magazine 2. As is not shown, the supply magazine 2 is electrically connected with the thermal printer. A sensor reads an indicia on an end face of the tubular spool shaft 12, and generates a detection signal which is input to the printer through a line of the connection.

If a printing command signal is input in the color thermal printer, then preparing operation prior to printing is started. In the prior operation, an opener mechanism in the printer rotates the openable lid 95 in the supply magazine 2 to the open position, to open the supply passageway 93. The paper feeder mechanism in the printer rotates the transmission gear 91 in the supply magazine 2 in the counterclockwise direction. Thus, the recording paper roll 10 in contact with the supply roller 79 is rotated clockwise in FIG. 16.

Figure 13A:
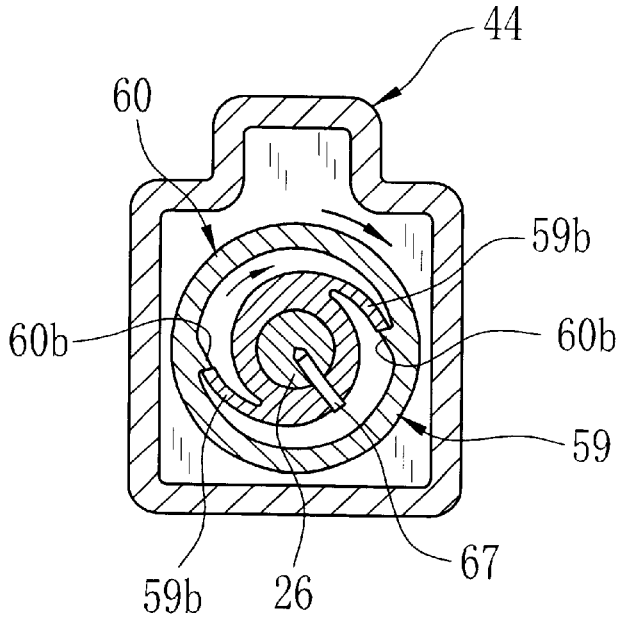
FIG. 13A is a cross section illustrating a state of connection at a one-way clutch.
Figure 13B:
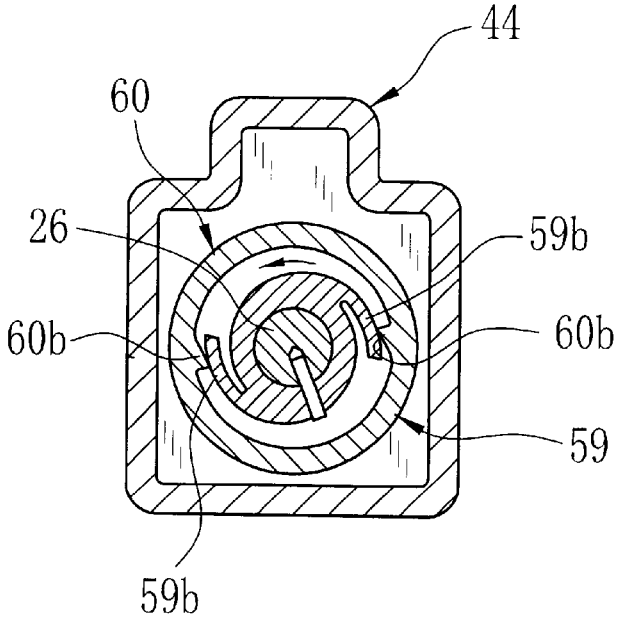
FIG. 13B is a cross section illustrating a state of disconnection at the one-way clutch.
Figure 14:
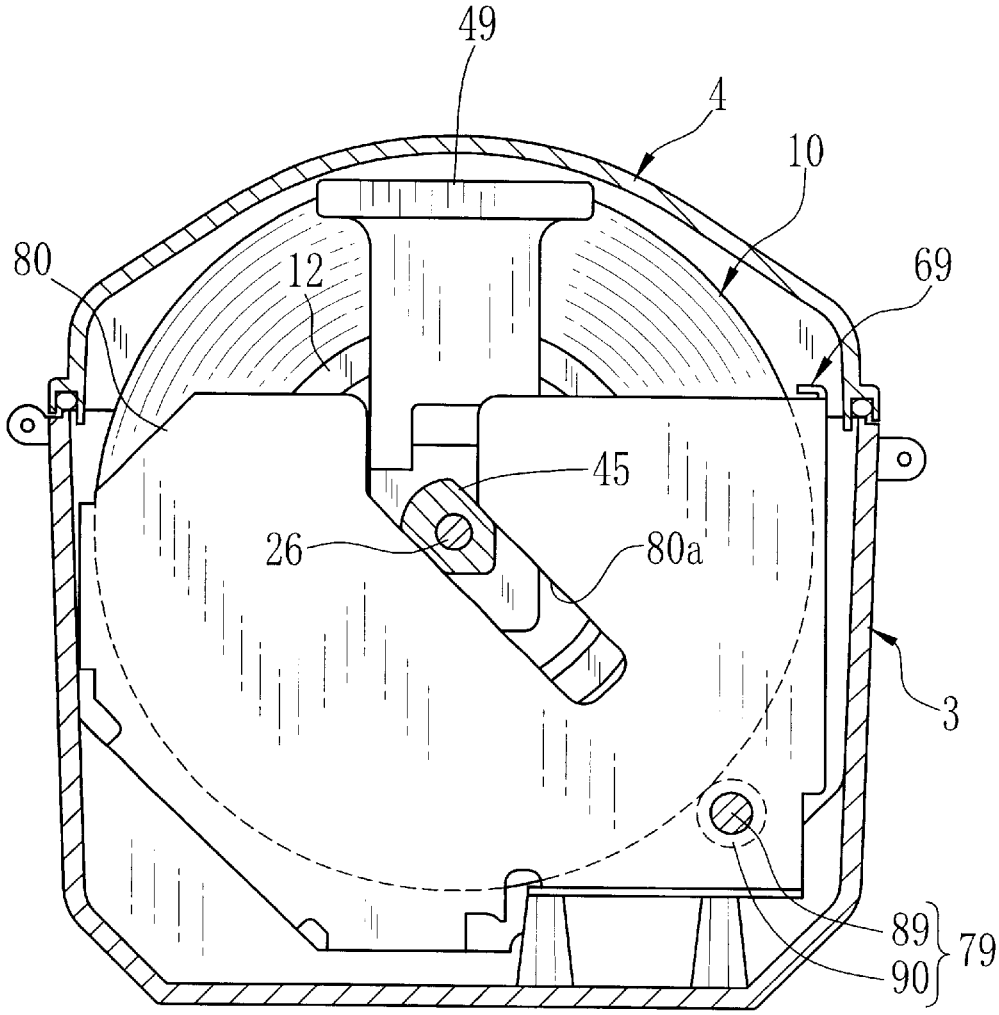
FIG. 14 is a side elevation illustrating an appropriate state of setting each bearing assembly in a cutout.

Upon the rotation of the recording paper roll 10, rotation is transmitted to the rotational shafts 26 and 75 by the first and second holder cores 20 and 23. In FIGS. 10, 13A and 13B, the ratchet wheel 59 rotates together with the rotational shaft 26 rotating in the unwinding direction. In FIG. 13A, the ratchet claws 59*b* come in contact with the teeth 60*b* of the tube 60, which rotates together with the ratchet wheel 59. An end face of the tube 60 frictionally contacts the friction pad 61. Thus, rotational load of the rotational shaft 26 or the recording paper roll 10 becomes higher.

When the recording paper roll 10 rotates in the unwinding direction, a front edge of the recording paper 13 is separated from the recording paper roll 10. A guide surface 3*a* with an inclination in the magazine body 3 guides the front edge of the recording paper 13 and exits the same through the supply passageway 93. Note that it is preferable to use a separator mechanism, disposed in the supply magazine 2, for separating the front edge of the recording paper 13 from the recording paper roll 10.

The recording paper 13 fed from the supply magazine 2 is subjected to full-color printing, and cut into each sheet at a predetermined print size before ejection from the inside of the printer. While the recording paper 13 is fed, the one-way clutch 57 causes the friction pad 61 to apply back tension to the recording paper 13. Reliability in the feeding can be high to prevent oblique movement or jamming.

When the printing is completed, the drive mechanism for feeding in the printer rotates the transmission gear 91 in the winding direction. The recording paper roll 10 is rotated backwards to rewind the recording paper 13 into the supply magazine 2. In FIG. 13B, the ratchet claws 59*b* in the ratchet wheel 59 are deformed resiliently and move past the teeth 60*b*. The tube 60 does not rotate, and causes drop in the rotational load to the recording paper roll 10. Thus, no difference occurs in an angular speed between the inner turns and the outermost turn of the recording paper roll 10. No looseness occurs in the recording paper roll 10.

In the above embodiment, end faces of the recording paper roll 10 are pushed by the handles 49 when the recording paper roll 10 is raised by holding the handles 49. Furthermore, it is preferable to provide handles which can be ineffective upon setting of the roll into a magazine. A preferred embodiment with this feature is hereinafter described. Elements similar to those in the above embodiment are designated with identical reference numerals.

Figure 17:
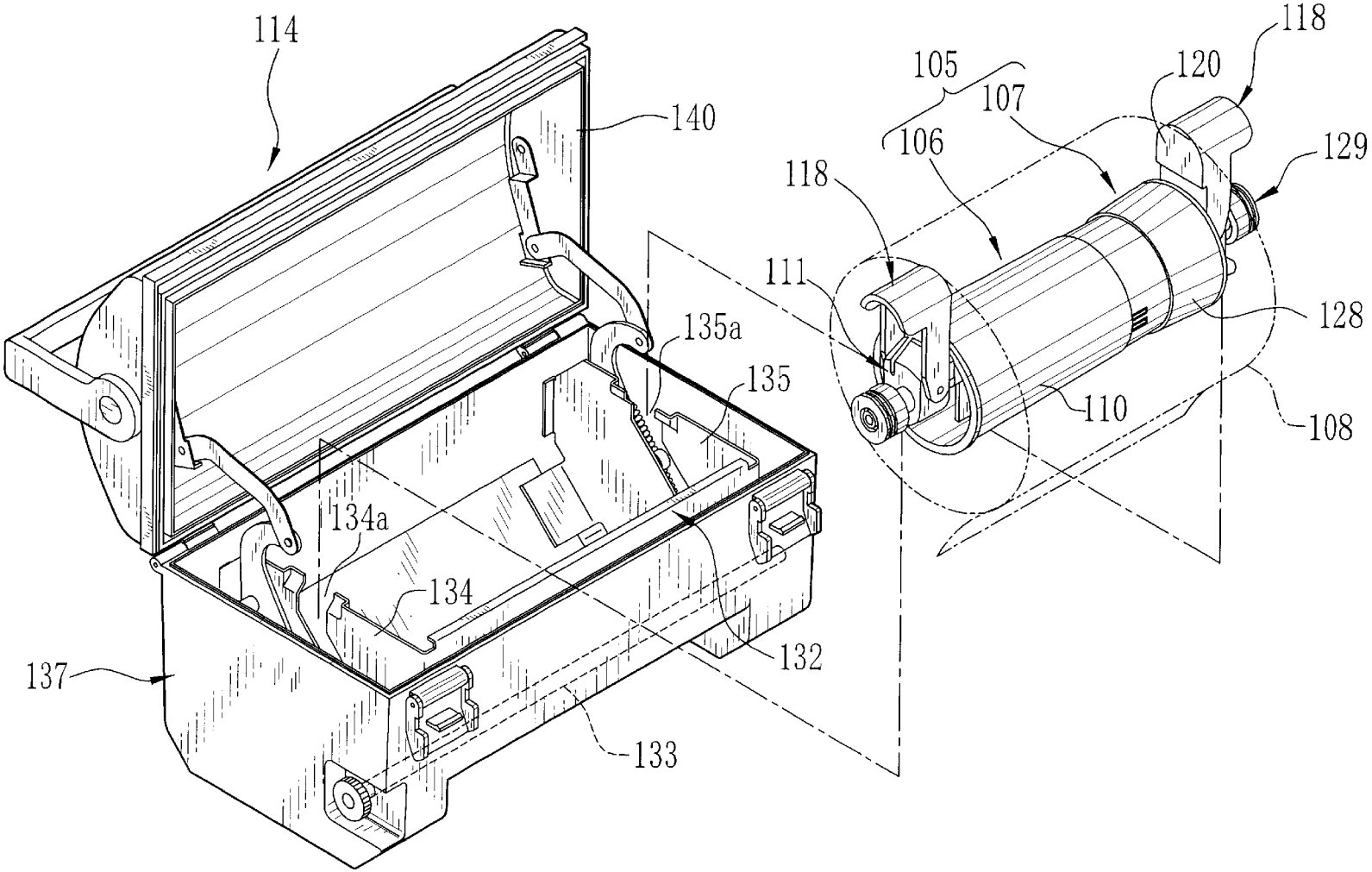
FIG. 17 is an exploded perspective illustrating another preferred combination of a supply magazine, a roll holder device and the recording paper roll.
Figure 18:
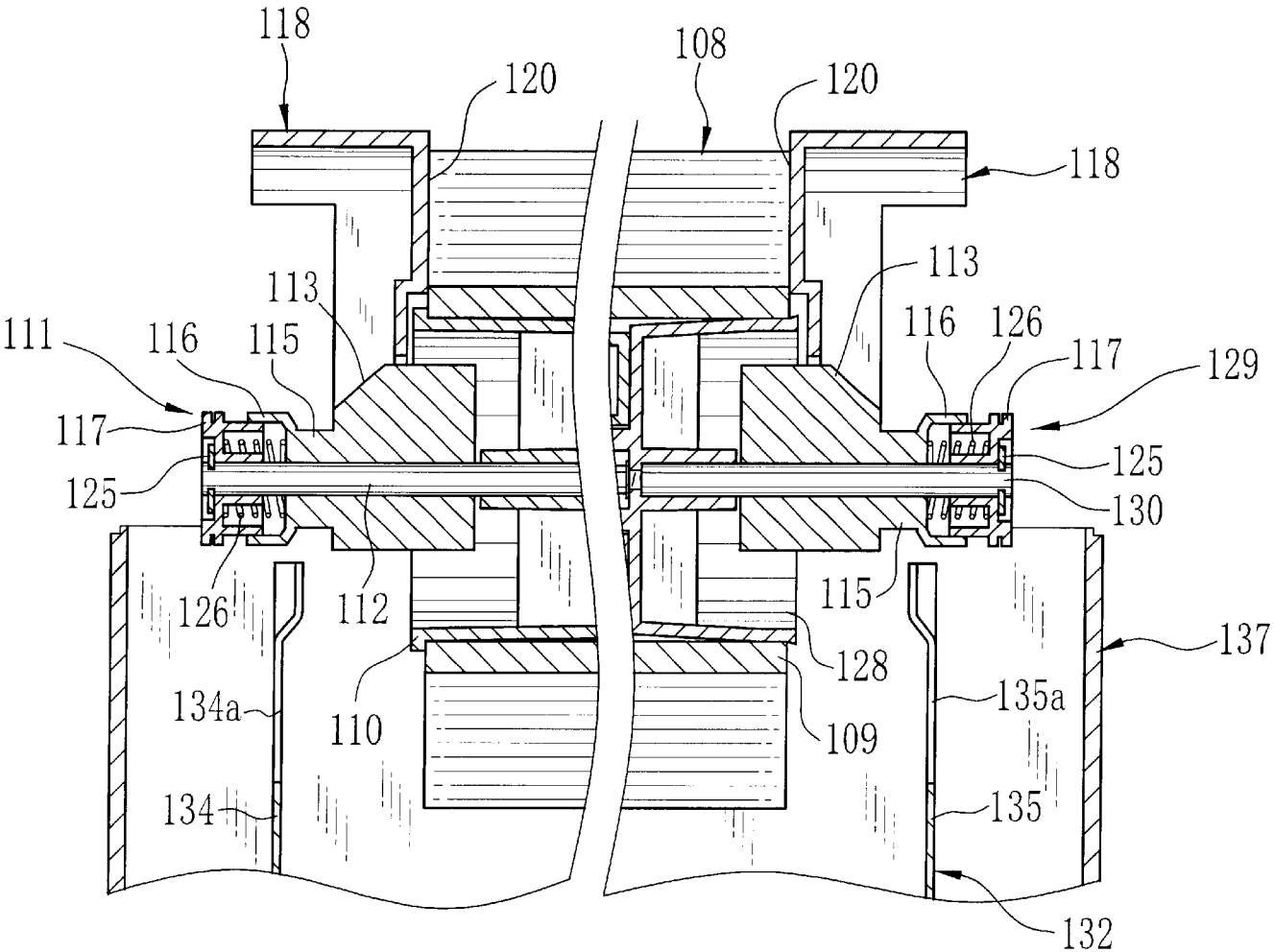
FIG. 18 is a vertical section, partially cutaway, illustrating a state upon setting handles on the recording paper roll.
Figure 19:
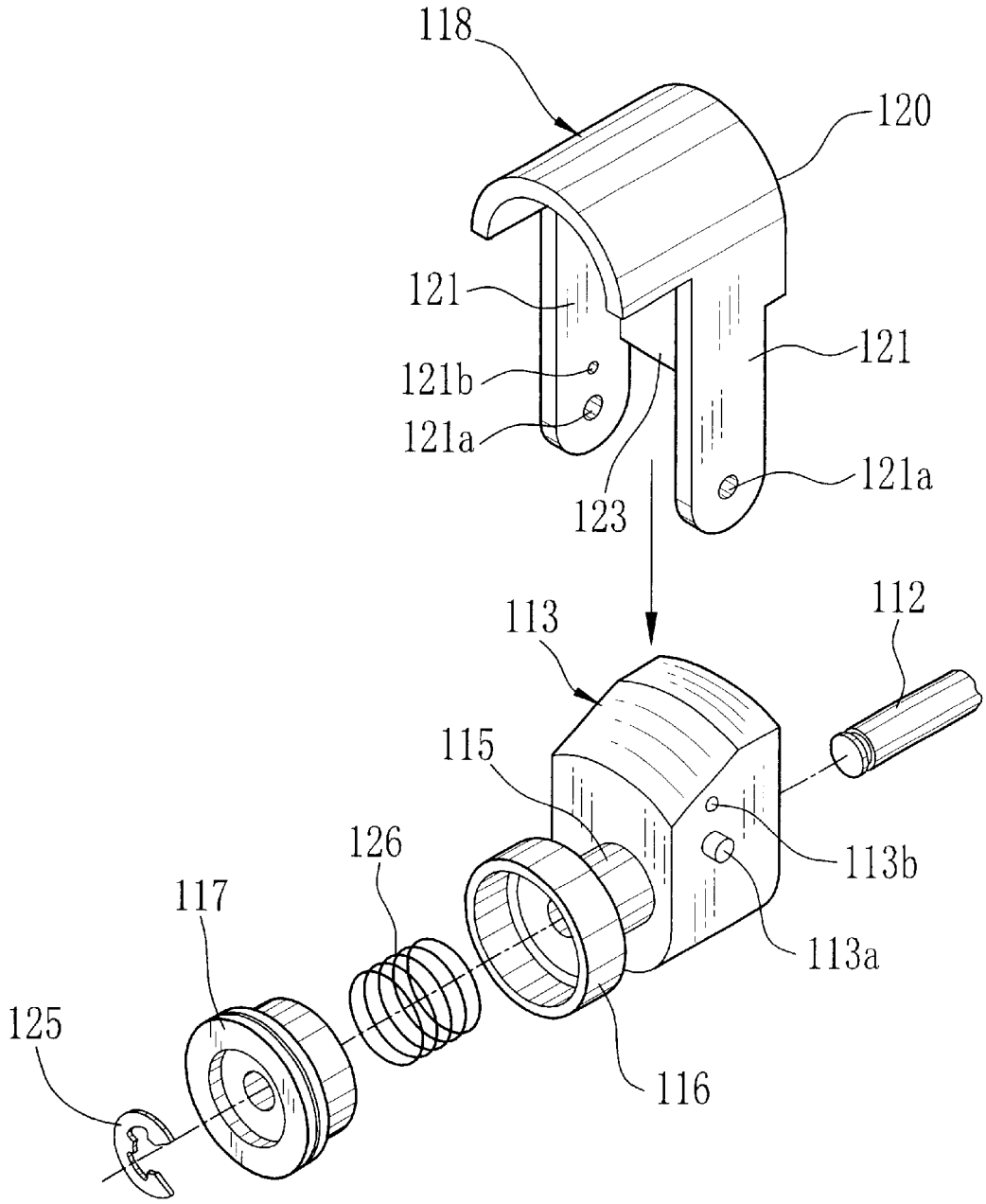
FIG. 19 is an exploded perspective illustrating a bearing assembly of the roll holder device.

In FIGS. 17 and 18, a roll holder device 105 is constituted by a longer holder component 106 and a shorter holder component 107. The longer holder component 106 includes a first holder core 110 and a first bearing assembly 111. The first holder core 110 has a cylindrical shape. The first bearing assembly 111 supports the first holder core 110. A recording paper roll 108 as recording material roll includes a tubular spool shaft 109, in which the first holder core 110 is inserted. In FIG. 19, the first bearing assembly 111 includes a block-shaped base member 113, a bearing portion 115, a great-diameter portion 116 as unblocking mechanism, a cap 117 and a roll regulator handle 118. The bearing portion 115 is formed with the base member 113 as a single piece, and supported inside a supply magazine 114. The great-diameter portion 116 is formed with an end of the bearing portion 115 as a single piece. The cap 117 is inserted in the great-diameter portion 116. The roll regulator handle 118 is secured to the base member 113. A rotational shaft 112 is supported by the base member 113 in a rotatable manner, and is provided with the first holder core 110 secured thereto.

The roll regulator handles 118 has a substantially L-shape as viewed in section, and includes a contact surface 120 at an upper end and arms 121 at a lower end. The contact surface 120 contacts an end face of the recording paper roll 108. Holes 121*a* are formed in the arms 121. A pin 113*a* is formed on each lateral face of the base member 113, and inserted in the holes 121*a* to support the arms 121 in a rotatable manner. The roll regulator handle 118 is kept rotatable between vertical and horizontal positions, and when in the vertical position, set the contact surface 120 to face the end face of the recording paper roll 108 by an orientation vertical to the rotational shaft 112, and when in the horizontal position, are extend parallel to the contact surface 120.

A middle plate 123 is disposed between the arms 121, and when the roll regulator handle 118 is swung to the vertical position, contacts the upper face of the base member 113. The contact surface 120 of the roll regulator handle 118 does not swing toward the end faces of the recording paper roll 108 beyond the vertical position. Recesses 121*b* are formed in an inner wall of the arms 121. Projections 113*b* are formed with faces of the base member 113 and engageable with the recesses 121*b* upon swinging of the roll regulator handle 118 to the vertical position. Thus, there occurs no accidental fall of the roll regulator handle 118 from the vertical position to the horizontal position even upon occurrence of a shock or vibration.

An E-ring 125 is fitted on an end of the contact surface 120 to keep the same from being dropped after insertion into the base member 113 and the cap 117. The cap 117 has a tubular shape. A coil spring 126 as bias mechanism is inserted between the cap 117 and the great-diameter portion 116. The coil spring 126 pushes an inner face of the great-diameter portion 116 to bias the base member 113 in a direction for insertion into the first holder core 110. When the longer holder component 106 is fitted on the recording paper roll 108, the biasing of the coil spring 126 to the roll regulator handle 118 causes the contact surface 120 to contact the end face of the recording paper roll 108.

The shorter holder component 107 includes a second holder core 128, a second bearing assembly 129 and a rotational shaft 130. The second holder core 128 is inserted in the tubular spool shaft 109 in the recording paper roll 108. The second bearing assembly 129 is disposed at a rear end of the second holder core 128. The rotational shaft 130 is secured to the second holder core 128, and rotatable together with the same.

The second bearing assembly 129 of the shorter holder component 107 is structurally the same as the first bearing assembly 111 of the longer holder component 106. Elements similar to those of the longer holder component 106 are designated with identical reference numerals. In a manner similar to the first bearing assembly 111, the second bearing assembly 129 has a second of the roll regulator handles 118 pressed against an end face of the recording paper roll 108. When the longer and shorter holder components 106 and 107 are secured to the ends of the tubular spool shaft 109 of the recording paper roll 108, the end faces of the recording paper roll 108 are squeezed by the roll regulator handles 118 with the contact surface 120, and are prevented from being loose. Also, the recording paper roll 108 can be kept from being uneven.

A magazine body 137 contains a holder frame or support frame 132 and a supply roller 133. The holder frame 132 supports the roll holder device 105 on which the recording paper roll 108 is fitted. The holder frame 132 is formed by cutting and flexing a plate of metal with a small thickness. Frame walls 134 and 135 in the holder frame 132 are erect vertically in the magazine body 137.

Cutouts 134*a* and 135*a* or slits are formed in the frame walls 134 and 135 for insertion of the bearing portion 115 of the longer and shorter holder components 106 and 107. Upper open ends of the cutouts 134*a* and 135*a* are flexed toward the center of the supply magazine 114 to facilitating receipt of the bearing portion 115 of the longer and shorter holder components 106 and 107. A magazine lid 140 is openably closes the magazine body 137.

Figure 20:
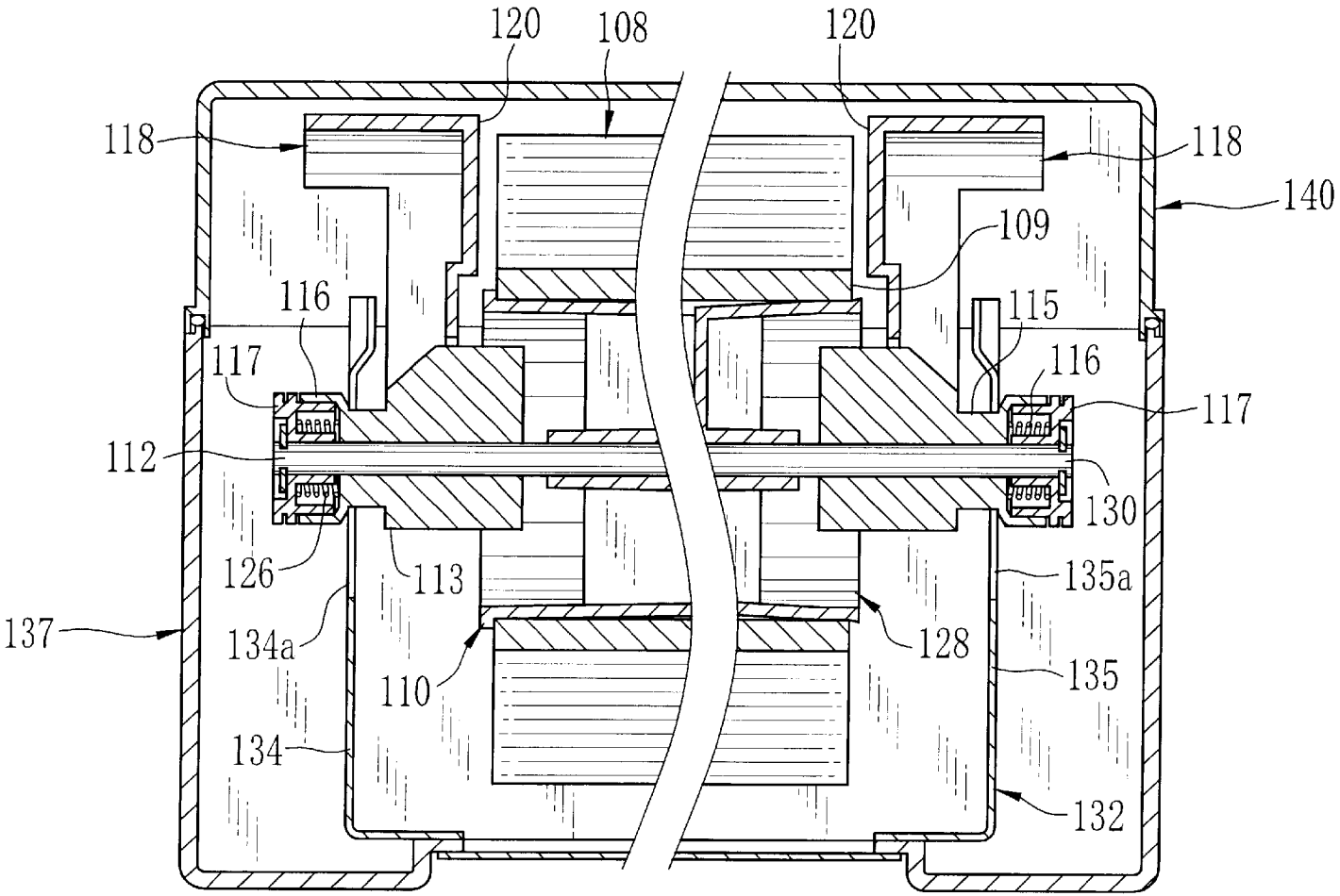
FIG. 20 is a vertical section, partially cutaway, illustrating a state upon setting the roll holder device in the recording paper roll in release the handles.

When the recording paper roll 108 with the roll holder device 105 is set in the supply magazine 114, the bearing portion 115 is inserted in the cutouts 134*a* and 135*a*. As the upper portion of the edges of the cutouts 134*a* and 135*a* is flexed, there occurs no interference of the great-diameter portion 116 with the frame walls 134 and 135. In FIG. 20, the recording paper roll 108 is moved more deeply into the magazine body 137. The frame walls 134 and 135 push the great-diameter portion 116 of the first and second bearing assemblies 111 and 129. Upon the push of the great-diameter portion 116, the base member 113 is slid away from the recording paper roll 108 against the bias of the coil spring 126. The contact surface 120 of the roll regulator handles 118 is moved away from the end faces of the recording paper roll 108. Thus, the roll regulator handles 118 can be removed from the recording paper roll 108 even without additional operation after setting of the recording paper roll 108 to the magazine body 137.

In the above embodiments, the plate springs 39 are used to bias the anti-dropping levers 37 in a direction for preventing a drop. However, a member for biasing the anti-dropping levers 37 may be other elements such as a coil spring. Furthermore, the anti-dropping levers 37 may be provided with resiliency for biasing in a direction for preventing a drop.

In the above embodiments, the longer holder component 15, 106 and the shorter holder component 16, 107 in the roll holder device 11, 105 are engaged with each other upon being fitted on the recording paper roll 10, 108. However, the roll holder device 11, 105 may include the longer holder component 15, 106 and the shorter holder component 16, 107 not engaged with each other.

In the above embodiment, the contact surface 54 of the handles 49, 118 is provided with the ridges 53. Alternatively, the contact surface 54 of the handles 49, 118 may be provided with any construction for high friction in contact with an end face of the recording paper roll 10, 108. For example, the contact surface 54 can be finished in a knurled surface, or can be provided with a sheet or film of rubber, elastomer or the like with high friction.

In the above embodiments, the recording paper roll 10, 108 is moved toward the supply roller 79, 133. Alternatively, the supply roller 79, 133 in the supply magazine 2 or a printer may be movable toward the recording paper roll 10, 108. There is no need of sliding of the inclined bearing portion 45, 77 of the roll holder device 11, 105 with respect to the cutouts 80*a*, 81*a*, 134*a* and 135*a*. Thus, it is possible to form the inclined bearing portion 45, 77 and the cutouts 80*a*, 81*a*, 134*a* and 135*a* in any suitable shape such as a triangular or polygonal shape, to prevent inappropriate setting of the recording paper roll 10, 108.

In the above embodiment, the printer for use with the roll holder device 11, 105 of the invention is the color thermal printer. Furthermore, a printer for use with the roll holder device 11, 105 of the invention may be any type, such as a thermal transfer printer, an ink-jet printer or a printer according to electrophotography. Also, the roll holder device 11, 105 of the invention may be a type directly settable in the printer without the use of the supply magazine 2.

In the above embodiments, the anti-dropping levers 37 are pivotally movable to swing. However, the anti-dropping levers 37 may be a type slidable straight.

Also, the recording paper 13 in the recording paper roll 10, 108 for being held in the roll holder device 11, 105 of the invention may be recording sheet or film of a continuous shape or strip shape.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A roll holder device for loading of a supply magazine with a recording material roll in a rotatable manner, said recording material roll including a tubular spool shaft and continuous recording material wound about said tubular spool shaft in a roll form, said roll holder device comprising:

first and second holder cores inserted in respective first and second ends of said tubular spool shaft;

first and second stationary sections, supported on a holder frame member of said supply magazine stationarily and removably, for supporting respectively said first and second holder cores in a rotatable manner;

an anti-dropping mechanism provided on one of said first and second holder cores for pushing against a shaft inner surface of said tubular spool shaft and preventing said first and second holder cores from dropping from said tubular spool shaft; and a bias member for biasing and pressing said anti-dropping mechanism against said shaft inner surface, said bias member being attached to an inner surface of the first holder core.

2. A roll holder device as defined in claim 1, wherein said anti-dropping mechanism includes:

a push surface for contacting said shaft inner surface; and a plurality of claws formed on said push surface, said plurality of claws for being thrust into said shaft inner surface by said biasing member.

3. A roll holder device as defined in claim 2, wherein said first holder core has a longer size than said second holder core.

4. A roll holder device as defined in claim 3, wherein ends of said first and second holder cores are connectable with each other.

5. A roll holder device as defined in claim 1, further comprising:

a roll regulator mechanism for pushing a pair of end faces of said recording material roll, to prevent looseness of said recording material roll;

an unblocking mechanism for releasing said recording material roll from pressure of said roll regulator mechanism in response to setting of said recording material roll in said supply magazine.

6. A roll holder device as defined in claim 5, further comprising a bias mechanism for biasing said roll regulator mechanism toward said end faces of said recording material roll;

wherein said unblocking mechanism moves said roll regulator mechanism away from said end faces of said recording material roll against said bias mechanism upon being set in said supply magazine.

7. A roll holder device as defined in claim 6, wherein said roll regulator mechanism includes first and second handle members, set at said first and second ends of said tubular spool shaft in a pivotally movable manner, for coming substantially erect to first and second bearing members upon being moved up, to push end faces of said recording material roll.

8. A roll holder device as defined in claim 7, wherein said first and second stationary sections include respectively said first and second bearing members, fitted in first and second cutouts stationarily and removably, for supporting said first and second holder cores in a rotatable manner;

wherein said first and second handle members are secured to said first and second bearing members in a pivotally movable manner, and said bias mechanism biases each of said first and second bearing members toward said recording material roll.

9. A roll holder device as defined in claim 8, wherein said supply magazine includes an inclined edge portion, formed at an open end of each said cutout, inclined toward an inside of said holder frame member, for guiding insertion of said each bearing member into said cutout;

wherein said unblocking mechanism includes a great-diameter portion, formed at an axial end of said each bearing member with a greater diameter, pushed by an edge of said cutout by insertion of said each bearing members into said cutout, for sliding said each bearing member away from said recording material roll.

10. A roll holder device for loading of a supply magazine with a recording material roll in a rotatable manner, said recording material roll including a tubular spool shaft and continuous recording material wound about said tubular spool shaft in a roll form, said roll holder device comprising:

first and second holder cores inserted in respective first and second ends of said tubular spool shaft;

first and second stationary sections, supported on a holder frame member of said supply magazine stationarily and removably, for supporting respectively said first and second holder cores in a rotatable manner;

an anti-dropping mechanism for pushing a shaft inner surface of said tubular spool shaft and preventing said first and second holder cores from dropping from said tubular spool shaft;

a bias member for biasing and pressing said anti-dropping mechanism against said shaft inner surface;

wherein said anti-dropping mechanism includes:

a push surface for contacting said shaft inner surface; and plural claws, formed with said push surface, for being thrust into said shaft inner surface, wherein ends of said first and second holder cores are connectable with each other, and a core sleeve secured to said first holder core; and an access opening formed through said core sleeve, wherein said anti-dropping mechanism includes an anti-dropping lever and said push surface, said anti-dropping lever shiftable between first and second positions, contained in said core sleeve when in said first position, and protruded toward an outside of said core sleeve through said access opening when in said second position, said anti-dropping lever for pressing said push surface against said shaft inner surface.

11. A roll holder device as defined in claim 10, wherein said anti-dropping lever has a driven end portion disposed in said core sleeve;

wherein said roll holder device further comprises a connection shaft formed with said second holder core and inserted in said core sleeve, said connection shaft for shifting said anti-dropping lever from said first position to said second position by pushing said driven end portion.

12. A roll holder device as defined in claim 10, wherein said first and second holder cores are rotatable in unwinding and winding directions; and wherein said roll holder device further comprises a load changer mechanism for applying higher rotational load to said first and second holder cores during rotation of said first and second holder cores in said unwinding direction than during rotation of said first and second holder cores in said winding direction.

13. A roll holder device as defined in claim 10, wherein first and second cutouts are formed in said holder frame member, for supporting respectively said first and second stationary sections in a rotatable manner; and at least one orientation regulator mechanism for preventing said first holder core from being set in said second cutout or said second holder core from being set in said first cutout.

14. A roll holder device as defined in claim 13, wherein said first and second stationary sections include respectively first and second bearing members, inserted in respectively said first and second cutouts, for supporting said first and second holder cores in a rotatable manner, to constitute said at least one orientation regulator mechanism.

15. A roll holder device for loading of a supply magazine with a recording material roll in a rotatable manner, said recording material roll including a tubular spool shaft and continuous recording material wound about said tubular spool shaft in a roll form, said roll holder device comprising:

first and second holder cores inserted in respective first and second ends of said tubular spool shaft;

first and second stationary sections, supported on a holder frame member of said supply magazine stationarily and removably, for supporting respectively said first and second holder cores in a rotatable manner;

an anti-dropping mechanism for pushing against a shaft inner surface of said tubular spool shaft and preventing said first and second holder cores from dropping from said tubular spool shaft, wherein said first and second holder cores are rotatable in unwinding and winding directions; and a load changer mechanism for applying higher rotational load to said first and second holder cores during rotation of said first and second holder cores in said unwinding direction than during rotation of said first and second holder cores in said winding direction, wherein said load changer mechanism includes:

a friction pad member for exerting braking force to each of said first and second holder cores; and a one-way clutch for connecting said each holder core to said friction pad member during rotation of said first and second holder cores in said unwinding direction, and for disconnecting said each holder core from said friction pad member during rotation of said first and second holder cores in said winding direction;

wherein said friction pad member frictionally contacts one of said first and second stationary sections when connected with said each holder core.

16. A roll holder device as defined in claim 15, wherein said one-way clutch includes:

a ratchet wheel, which is secured to said each holder core, said ratchet wheel including at least one ratchet claw; and a tube member, which is provided with said friction pad member secured thereto, said tube member for containing said ratchet wheel, wherein said tube member has at least one tooth disposed inside, wherein said tube member rotates in said unwinding direction when said each holder core rotates in said unwinding direction by mesh of said tooth with said ratchet claw for exertion of said braking force to said each holder core, and wherein said tube member disengages said tooth from said ratchet claw when said each holder core rotates in said winding direction.

17. A roll holder device for loading of a supply magazine with a recording material roll in a rotatable manner, said recording material roll including a tubular spool shaft and continuous recording material wound about said tubular spool shaft in a roll form, said roll holder device comprising:

first and second holder cores inserted in respective first and second ends of said tubular spool shaft;

first and second stationary sections, supported on a holder frame member of said supply magazine stationarily and removably, for supporting respectively said first and second holder cores in a rotatable manner;

an anti-dropping mechanism for pushing against a shaft inner surface of said tubular spool shaft and preventing said first and second holder cores from dropping from said tubular spool shaft, wherein first and second cutouts are formed in said holder frame member, for supporting respectively said first and second stationary sections in a rotatable manner; and at least one orientation regulator mechanism for preventing said first holder core from being set in said second cutout or said second holder core from being set in said first cutout, wherein said first and second stationary sections include respectively first and second bearing members, inserted in respectively said first and second cutouts, for supporting said first and second holder cores in a rotatable manner, to constitute said at least one orientation regulator mechanism, wherein said first and second cutouts have respectively a pair of edges extending with an inclination relative to a vertical direction;

said at least one orientation regulator mechanism includes an inclined surface, formed on said first and second bearing members, inclined according to said pair of said edges, for blocking erroneous insertion of said first bearing member into said second cutout and of said second bearing member into said first cutout.

18. A roll holder device as defined in claim 17, further comprising first and second handle members, secured to said first and second bearing members in a pivotally movable manner, for coming substantially erect to said first and second bearing members upon being moved up, to push end faces of said recording material roll, to prevent looseness of said recording material roll.

19. A roll holder device for loading of a supply magazine with a recording material roll in a rotatable manner, said recording material roll including a tubular spool shaft and continuous recording material wound about said tubular spool shaft in a roll form, said roll holder device comprising:

first and second holder cores inserted in respective first and second ends of said tubular spool shaft;

first and second stationary sections, supported on a holder frame member of said supply magazine stationarily and removably, for supporting respectively said first and second holder cores in a rotatable manner; and a load changer mechanism for applying higher rotational load to said first and second holder cores during rotation of said first and second holder cores in said unwinding direction than during rotation of said first and second holder cores in said winding direction, wherein said load changer mechanism includes:

a friction pad member for exerting braking force to each of said first and second holder cores; and a one-way clutch for connecting said each holder core to said friction pad member during rotation of said first and second holder cores in said unwinding direction, and for disconnecting said each holder core from said friction pad member during rotation of said first and second holder cores in said winding direction.

20. A roll holder device as defined in claim 19, wherein said one-way clutch includes:

a ratchet wheel, which is secured to said each holder core, said ratchet wheel including at least one ratchet claw;

a tube member including said friction pad member secured thereto, for containing said ratchet wheel, wherein said tube member has at least one tooth disposed inside, wherein said tube member rotates in said unwinding direction when said each holder core rotates in said unwinding direction by mesh of said tooth with said ratchet claw for exertion of said braking force to said each holder core, and wherein said tube member disengages said tooth from said ratchet claw when said each holder core rotates in said winding direction.

21. A roll holder device for loading of a supply magazine with a recording material roll in a rotatable manner, said recording material roll including a tubular spool shaft and continuous recording material wound about said tubular spool shaft in a roll form, said supply magazine having a holder frame member with first and second cutouts for supporting said roll holder device, said roll holder device comprising:

first and second holder cores inserted in respective first and second ends of said tubular spool shaft;

first and second stationary sections, fitted in said first and second cutouts stationarily and removably, for supporting respectively said first and second holder cores in a rotatable manner; and at least one orientation regulator mechanism for preventing said first holder core from being set in said second cutout or said second holder core from being set in said first cutout, wherein said first and second stationary sections include respectively first and second bearing members, inserted in respectively said first and second cutouts, for supporting said first and second holder cores in a rotatable manner, to constitute said at least one orientation regulator mechanism, wherein said first and second cutouts have respectively a pair of edges extending with an inclination relative to a vertical direction;

wherein said at least one orientation regulator mechanism includes an inclined surface, formed on said first and second bearing members, inclined according to said pair of said edges, for blocking erroneous insertion of said first bearing member into said second cutout and of said second bearing member into said first cutout.

* * * * *